US010976766B2

(12) United States Patent
Kang et al.

(10) Patent No.: US 10,976,766 B2
(45) Date of Patent: Apr. 13, 2021

(54) PEDAL DEVICE FOR VEHICLE

(71) Applicant: SL Corporation, Daegu (KR)

(72) Inventors: Woojin Kang, Gyeongsan (KR); Changwen An, Gyeongsan (KR); Intae Hwang, Gyeongsan (KR)

(73) Assignee: SL Corporation, Daegu (KR)

( * ) Notice: Subject to any disclaimer, the term of this patent is extended or adjusted under 35 U.S.C. 154(b) by 0 days.

(21) Appl. No.: 16/814,520

(22) Filed: Mar. 10, 2020

(65) Prior Publication Data

US 2020/0293079 A1 Sep. 17, 2020

(30) Foreign Application Priority Data

Mar. 15, 2019 (KR) ..... 10-2019-0029832
Mar. 4, 2020 (KR) ..... 10-2020-0027104

(51) Int. Cl.

| | |
|---|---|
| ***G05G 1/30*** | (2008.04) |
| ***G05G 5/03*** | (2008.04) |
| ***G05G 1/38*** | (2008.04) |
| ***G05G 1/44*** | (2008.04) |
| ***G05G 5/05*** | (2006.01) |

(52) U.S. Cl.
CPC ..... *G05G 1/38* (2013.01); *G05G 1/44* (2013.01); *G05G 5/03* (2013.01); *G05G 5/05* (2013.01)

(58) Field of Classification Search
CPC .. G05G 1/30; G05G 1/38; G05G 1/40; G05G 1/44; G05G 1/445; G05G 5/03; G05G 5/05
See application file for complete search history.

(56) References Cited

U.S. PATENT DOCUMENTS 4,983,915 A * 1/1991 Rossi ..... G01D 5/2033 324/173
6,330,838 B1 * 12/2001 Kalsi ..... B60T 7/065 74/514
6,408,712 B1 * 6/2002 Bolisetty ..... G05G 1/30 74/514
6,426,619 B1 * 7/2002 Pfaffenberger ..... F02D 11/106 324/207.2

(Continued)

FOREIGN PATENT DOCUMENTS

DE 19630156 A1 * 1/1998 ..... B60K 26/021

OTHER PUBLICATIONS

Machine translation of DE 19630156 A1 obtained on May 26, 2020.*

*Primary Examiner* — Adam D Rogers
(74) *Attorney, Agent, or Firm* — Nelson Mullins Riley & Scarborough LLP; Kongsik Kim, Esq.

(57) ABSTRACT

A pedal device for a vehicle includes a pedal arm that is rotatable about a rotational axis in a pedal housing, a pedal reaction force generator for generating a pedal reaction force in a direction opposite to a direction in which an operating force of the pedal arm is applied via a pedal pad formed on the pedal arm, a friction force generator comprising a contact disposed at an end of the pedal arm proximate to the rotational axis and a contact surface formed on an inner surface of the pedal housing to be in contact with the contact of the pedal arm, and a position detection unit for detecting a position of the pedal arm. The position detection unit includes a magnet, in which two or more poles are arranged in a displacement direction and in a direction perpendicular to the displacement direction.

15 Claims, 20 Drawing Sheets

(56) References Cited

U.S. PATENT DOCUMENTS

| | | | | |
|---|---|---|---|---|
| 6,526,844 | B1 * | 3/2003 | Weis | F02D 11/02 74/513 |
| 7,073,408 | B2 * | 7/2006 | Kim | G05G 1/30 74/513 |
| 7,404,342 | B2 * | 7/2008 | Wurn | G05G 1/38 74/512 |
| 7,503,236 | B2 * | 3/2009 | Schlabach | G05G 1/30 74/512 |
| 9,465,403 | B2 * | 10/2016 | Kihara | G05G 1/38 |
| 10,248,152 | B2 * | 4/2019 | Kim | G05G 1/44 |
| 10,359,802 | B2 * | 7/2019 | Brown | B60W 10/02 |
| 10,401,896 | B1 * | 9/2019 | Kim | G05G 5/03 |
| 2006/0117902 | A1 * | 6/2006 | Martin | G05G 1/44 74/512 |
| 2006/0185469 | A1 * | 8/2006 | Schlabach | G05G 1/44 74/560 |
| 2008/0276749 | A1 * | 11/2008 | Stewart | G05G 1/38 74/512 |
| 2016/0102997 | A1 * | 4/2016 | Wurn | H01F 7/021 74/560 |
| 2019/0278318 | A1 * | 9/2019 | Park | B60K 26/021 |

* cited by examiner

PEDAL DEVICE FOR VEHICLE

CROSS-REFERENCE TO RELATED APPLICATION

This application claims the benefit of priority from Korean Patent Application No. 10-2019-0029832 filed on Mar. 15, 2019 and Korean Patent Application No. 10-2020-0027104 filed on Mar. 4, 2020, which applications are herein incorporated by reference in their entirety.

BACKGROUND

1. Technical Field

The present disclosure relates to a pedal device for a vehicle, and more particularly to a pedal device for a vehicle capable of generating hysteresis in a pedal reaction force when a driver operates a pedal.

2. Description of the Related Art

In general, an accelerator pedal provided in a vehicle is a device for accelerating the vehicle by adjusting the amount of air aspirated into an engine or the amount of fuel injected into the engine depending on an angle to which the pedal rotates by driver's stepping force. There are two types of accelerator pedals: a pendant type that is installed by hanging on a dash panel; and an organ type that is installed on a floor panel. Further, the accelerator pedal is divided into a mechanical type and an electronic type based on its operating principles.

The accelerator pedal generates hysteresis by varying the amount of force applied on the driver's foot when the driver steps on the pedal and when the driver releases the foot from the pedal, which reduces the fatigue experienced by the driver when operating the pedal. In general, the hysteresis is generated by a device that operates to generate friction in conjunction with the pedal when the pedal rotates.

However, providing a separate device for generating hysteresis when the driver operates the pedal presents a possibility that the number of components increases, and thus, the configuration becomes more complicated and the cost increases. Therefore, there is a demand for a method for more effectively generating the hysteresis while reducing the number of components.

SUMMARY

Aspects of the present disclosure provide a pedal device for a vehicle in which pedal reaction forces of different magnitudes are generated when a driver steps on a pedal and when the driver releases the foot from the pedal while the driver operates the pedal. Aspects of the present disclosure also provide a pedal device for a vehicle that may ensure the linearity of a detection signal output from a sensor based on a position of the pedal. However, aspects of the present disclosure are not restricted to those set forth herein. The above and other aspects of the present disclosure will become more apparent to one of ordinary skill in the art to which the present disclosure pertains by referencing the detailed description of the present disclosure given below.

According to an aspect of the present disclosure, a pedal device for a vehicle may include a pedal arm that is rotatable about a rotational axis in a pedal housing; a pedal reaction force generator for generating a pedal reaction force in a direction opposite to a direction in which an operating force of the pedal arm is applied via a pedal pad formed on the pedal arm; a friction force generator, the friction force generator comprising a contact disposed at an end of the pedal arm proximate to the rotational axis and a contact surface formed on an inner surface of the pedal housing to be in contact with the contact of the pedal arm. The friction force generator may generate a friction force between the contact and the contact surface as the pedal arm rotates. The pedal device for a vehicle may further include a position detection unit for detecting a position of the pedal arm. The position detection unit may comprise a magnet whose position may be changed as the pedal arm rotates, and a sensor unit for detecting a strength of a magnetic force based on the position of the magnet. In particular, two or more poles of the magnet may be alternately arranged in a displacement direction and a direction perpendicular thereto.

The contact surface may be formed to allow a distance from the rotational axis to the contact surface to gradually decrease going from a first side to a second side along a movement path of the contact. The contact may include an elastic member inserted into a receiving groove formed at the end of the pedal arm, and a bullet that is elastically supported by the elastic member to allow an end thereof to be in contact with the contact surface. The bullet may be pressed in a direction of compressing the elastic member by the contact surface as the pedal arm rotates by the operating force.

The pedal housing may include an insertion aperture formed at a rear side thereof to allow the end of the pedal arm to be inserted therethrough, and an opening formed on a front side thereof to be coupled to a support. Ends of the pedal reaction force generator may be supported by the support of the pedal housing and the pedal arm. The ends of the pedal reaction force generator may be respectively supported by a surface of the support and a surface of the pedal arm that face each other, and a rotation of the pedal arm due to the operating force may cause the pedal reaction force generator to be compressed as the surface of the pedal arm facing the support approaches the support and to generate a restoring force.

The friction force generator may generate a friction force depending on a force applied by the contact to the contact surface. In particular, in response to depressing the pedal pad, the friction force may be generated in a direction opposite to a direction in which the operating force is exerted, and in response to releasing the pedal pad, the friction force may be generated in a direction opposite to a direction in which the pedal reaction force is exerted.

The magnet may be spaced apart from the rotational axis of the pedal arm by a predetermined interval and may rotate about the rotational axis of the pedal arm as the pedal arm rotates. The magnet may be disposed with a center thereof coinciding with the rotational axis of the pedal arm and may rotate about the rotational axis of the pedal arm as the pedal arm rotates. An N pole and an S pole of the magnet may be alternately arranged in the displacement direction and in the direction perpendicular thereto.

The two or more poles may be arranged in the magnet in the displacement direction and in the direction perpendicular to the displacement direction to allow a detected displacement of the magnet that is detected by the sensor to be greater than an actual displacement of the magnet. The sensor unit may detect the strength of the magnetic force corresponding to a magnetic force line that extends between the two or more poles arranged in the direction perpendicular to the displacement direction.

According to another aspect of the present disclosure, a pedal device for a vehicle may include a pedal carrier that is rotatable about a rotational axis in a pedal housing, a pedal reaction force generator for generating a pedal reaction force in a direction opposite to a direction of an operating force applied to the pedal carrier, a friction force generator for generating a friction force that provides a resistance as the pedal carrier rotates, and a position detection unit for detecting a position of the pedal carrier. The position detection unit may include a magnet, wherein a position of the magnet is changed as the pedal carrier rotates, and a sensor unit for detecting a strength of a magnetic force based on displacement of the magnet. In particular, two or more poles may be arranged in the magnet in a displacement direction and in a direction perpendicular to the displacement direction. The friction force may increase as a rotation angle of the pedal carrier is increased. The pedal device may further include a pedal pad configured to transmit the operating force to the pedal carrier.

The friction force generator may include a rotating unit that is rotatably coupled to a shaft of the pedal housing, an extension that protrudes from the rotating unit, a lever including a first end and a second end, and an elastic member inserted between the first end of the lever and the extension. In particular, the second end of the lever may apply a force to an outer surface of the rotating unit to generate the friction force. In response the depressing the pedal carrier, the force may be applied to the outer surface of the rotating unit by the lever, and the friction force between an inner surface of the rotating unit and an outer surface of the shaft of the pedal housing may be increased.

A pedal device for a vehicle according to the present disclosure has one or more of the following benefits. When the driver operates the pedal, friction forces of different magnitudes are generated depending on a magnitude of an operating force applied to the pedal, and the friction forces act in different directions when the driver steps on the pedal and when the driver releases the foot from the pedal, thereby generating hysteresis, which may reduce the fatigue of the driver for the pedaling operation. Further, the size of the pedal may be prevented from increasing, and the configuration may be simplified, while ensuring the linearity of the detection signal output from the sensor that detects the position of the pedal. The benefits of the present disclosure are not limited to the above-mentioned benefits, and other benefits not mentioned may be clearly understood by a person skilled in the art from the claims.

BRIEF DESCRIPTION OF THE DRAWINGS

The above and other aspects and features of the present disclosure will become more apparent by describing in detail exemplary embodiments thereof with reference to the attached drawings, in which.

DETAILED DESCRIPTION

Figure 1:
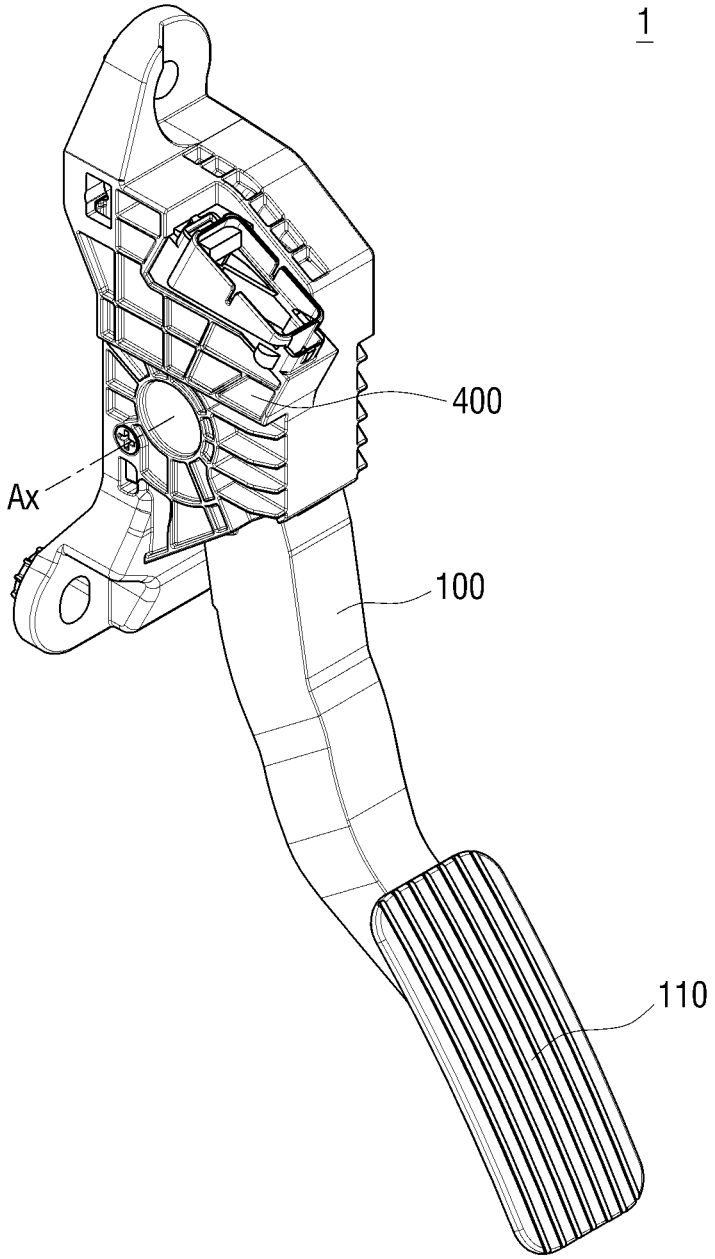
FIGS. 1 and 2 are perspective views showing a pedal device for a vehicle according to an exemplary embodiment of the present disclosure.

Advantages and features of the present disclosure and methods of accomplishing the same may be understood more readily by reference to the following detailed description of exemplary embodiments and the accompanying drawings. The present disclosure may, however, be embodied in many different forms and should not be construed as being limited to the exemplary embodiments set forth herein. Rather, these exemplary embodiments are provided so that this disclosure will be thorough and complete and will fully convey the concept of the disclosure to those skilled in the art, and the present disclosure will only be defined by the appended claims. Throughout the specification, like reference numerals in the drawings denote like elements. In some exemplary embodiments, well-known steps, structures and techniques will not be described in detail to avoid obscuring the disclosure.

The terminology used herein is for the purpose of describing particular exemplary embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Exemplary embodiments of the present disclosure are described herein with reference to plan, perspective, and cross-sectional illustrations that are schematic illustrations of idealized exemplary embodiments of the present disclosure. As such, variations from the shapes of the illustrations as a result, for example, of manufacturing techniques and/or tolerances, are to be expected. Thus, the exemplary embodiments of the present disclosure should not be construed as limited to the particular shapes of regions illustrated herein but are to include deviations in shapes that result, for example, from manufacturing. In the drawings, respective components may be enlarged or reduced in size for convenience of explanation.

Hereinafter, the present disclosure will be described with reference to the drawings for explaining a pedal device for a vehicle according to exemplary embodiments of the present disclosure.

Figure 2:
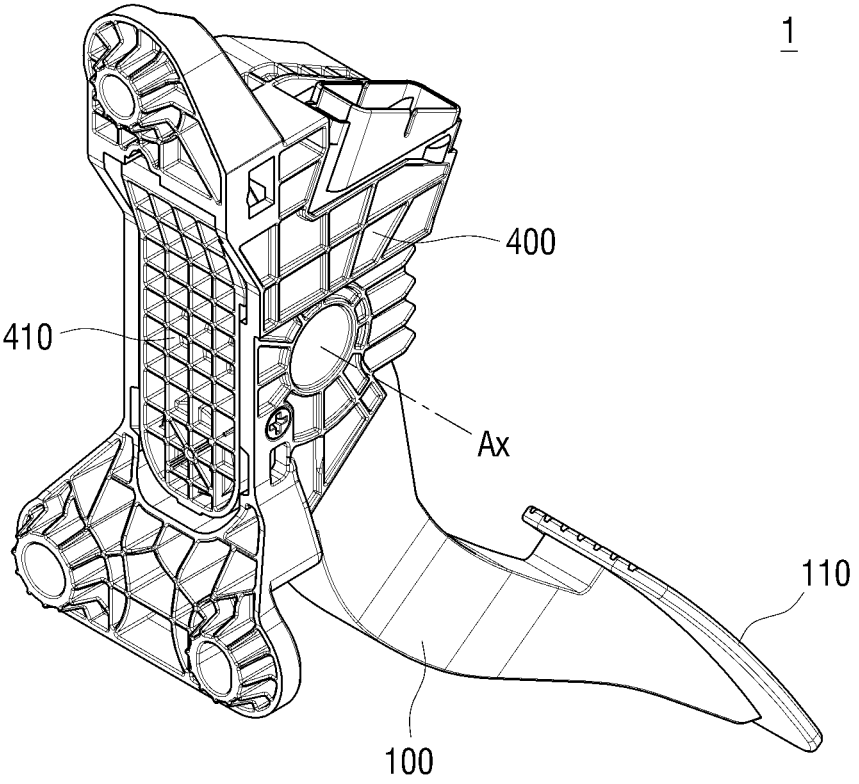
Figure 3:
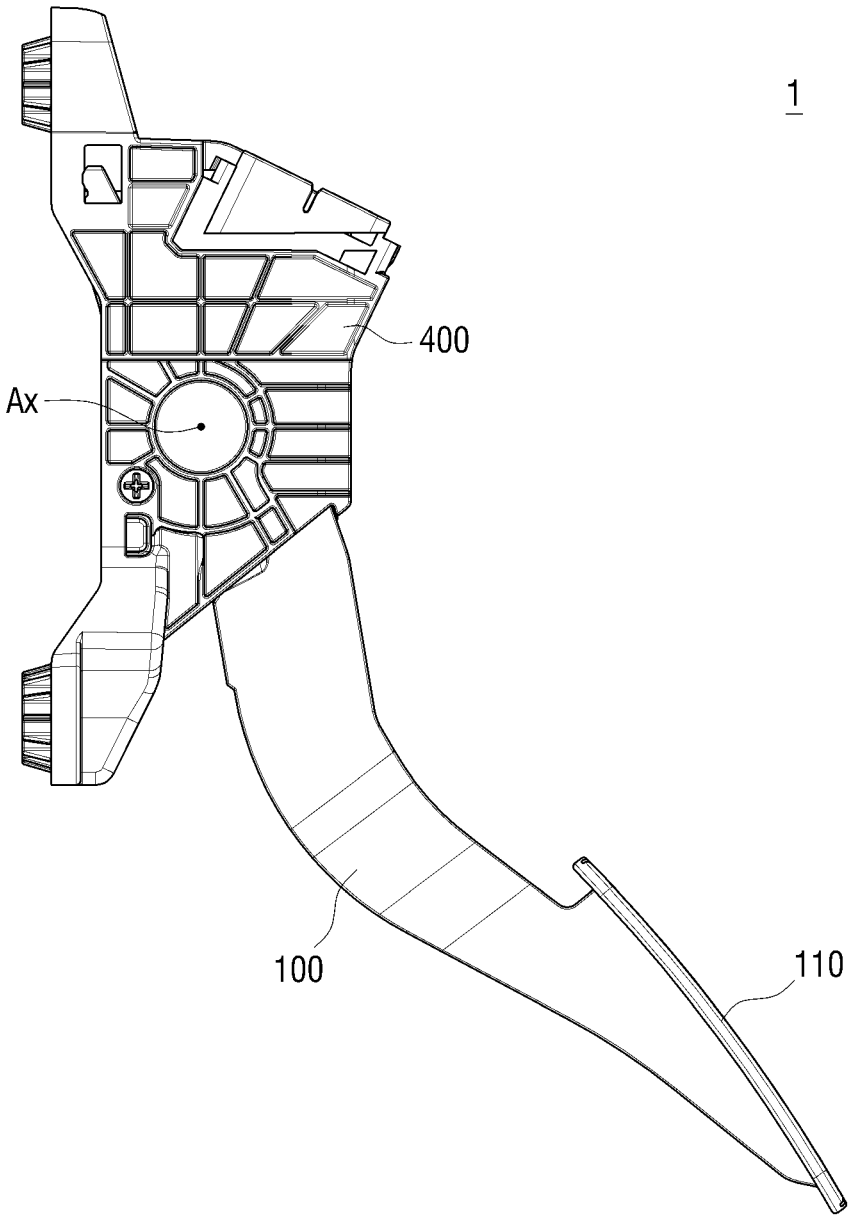
FIG. 3 is a side view showing a pedal device for a vehicle according to an exemplary embodiment of the present disclosure.
Figure 4:
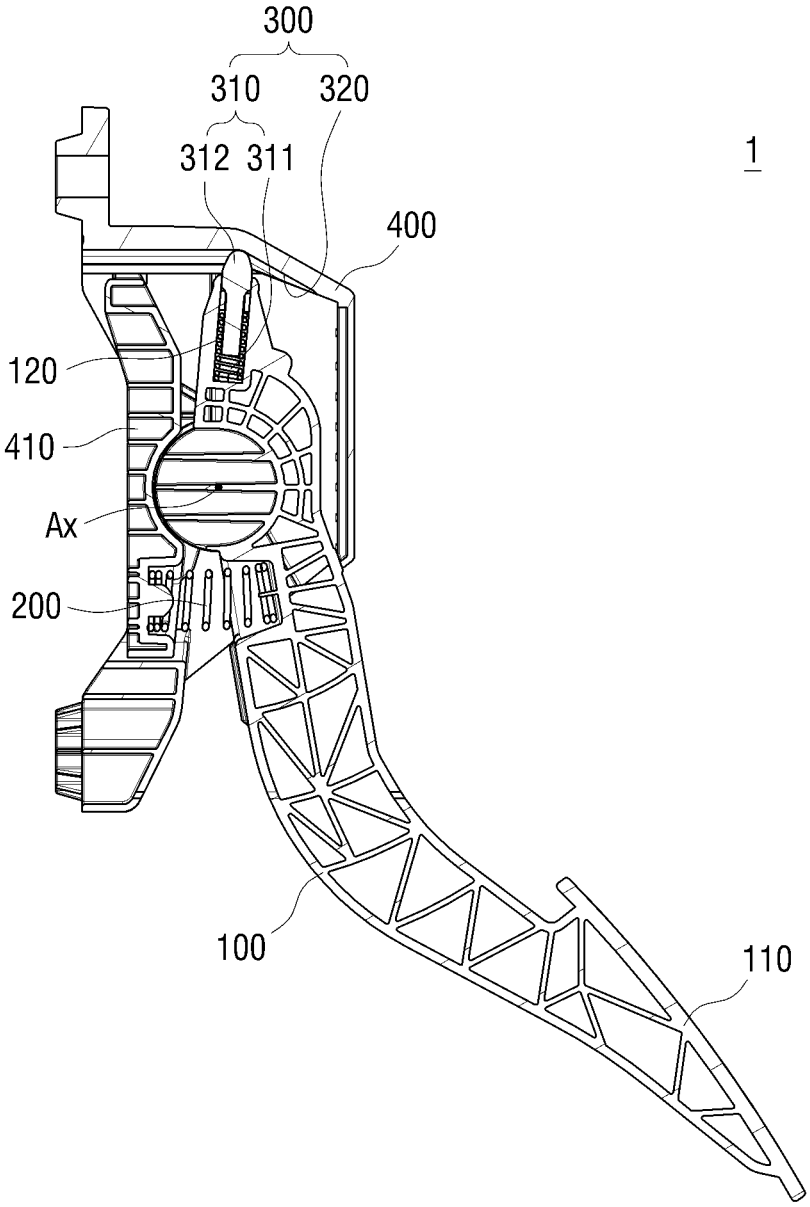
FIG. 4 is a cross-sectional view showing a pedal device for a vehicle according to an exemplary embodiment of the present disclosure.
Figure 5:
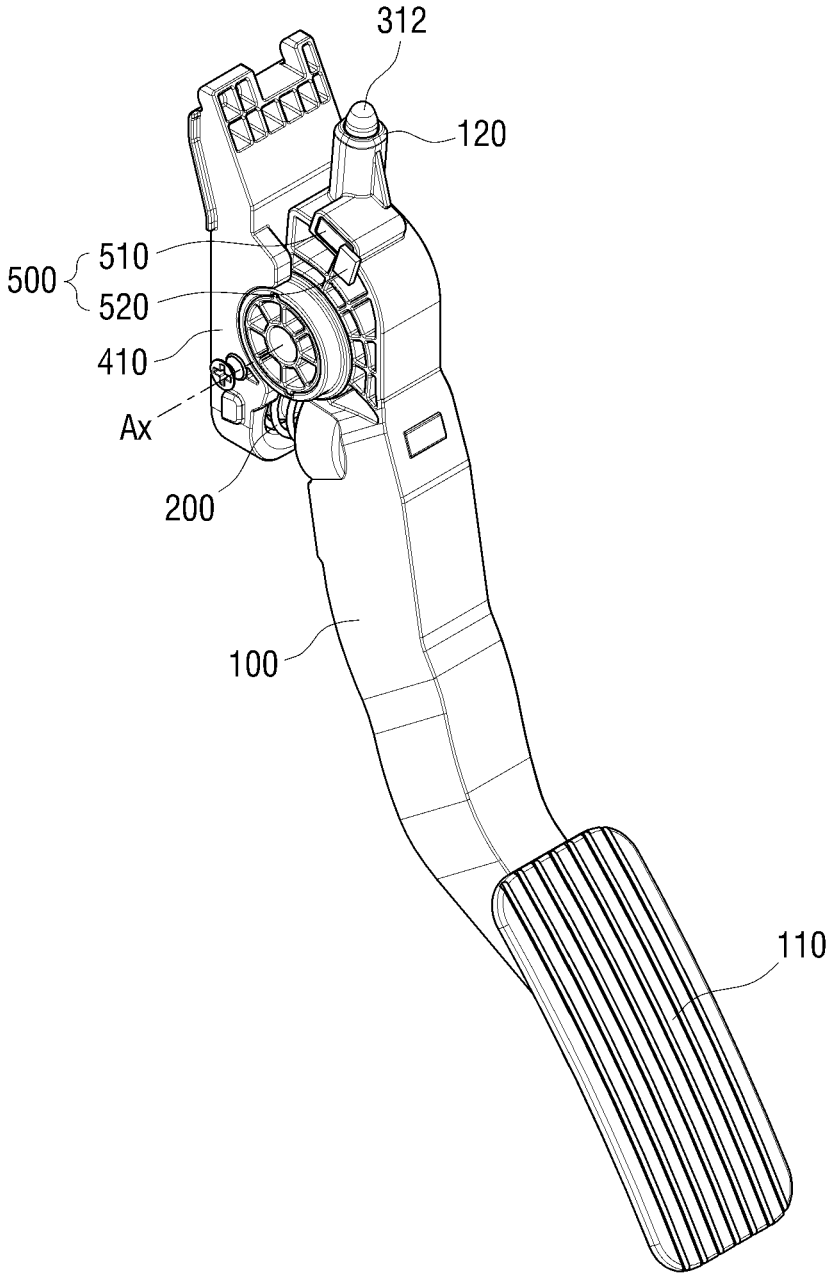
FIG. 5 is a perspective view showing a pedal arm according to an exemplary embodiment of the present disclosure.
Figure 6:
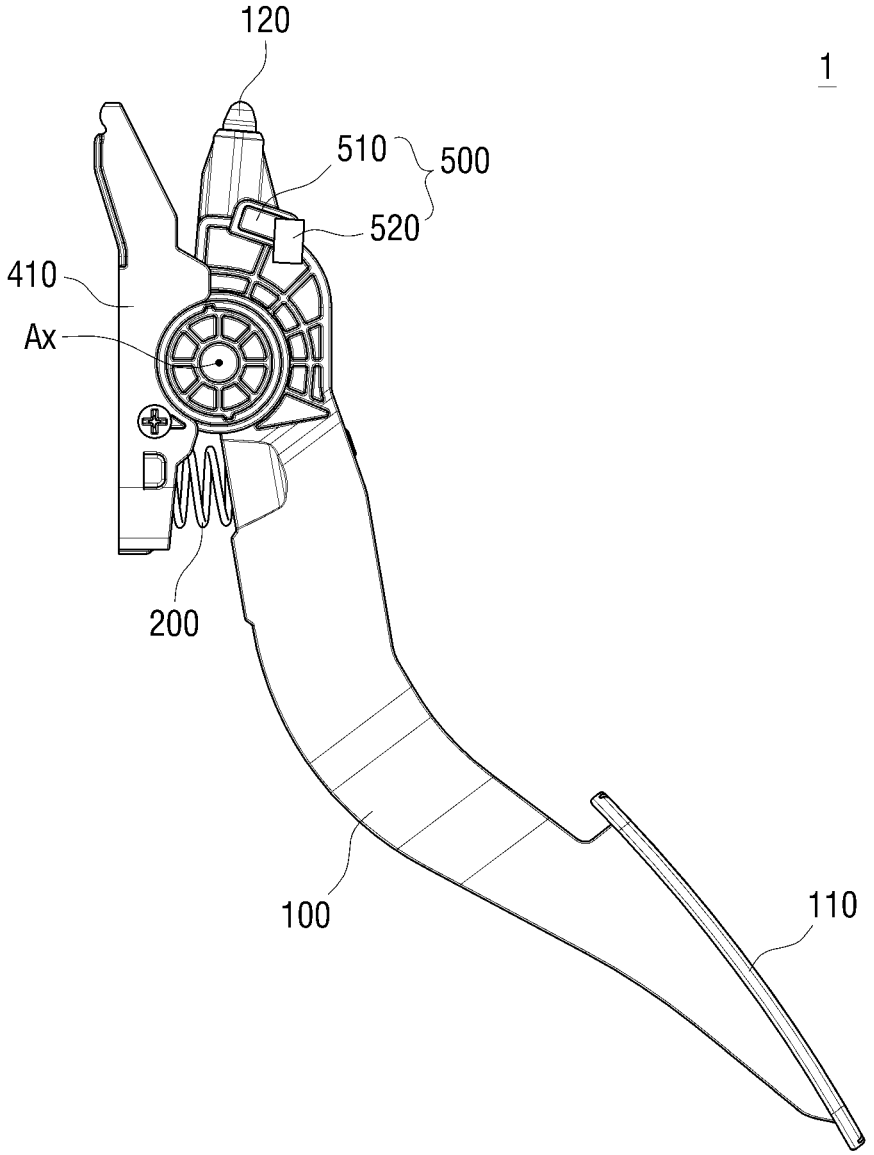
FIG. 6 is a side view showing a pedal arm according to an exemplary embodiment of the present disclosure.

FIGS. 1 and 2 are perspective views showing a pedal device for a vehicle according to an exemplary embodiment of the present disclosure. FIG. 3 is a side view showing a pedal device for a vehicle according to an exemplary embodiment of the present disclosure. FIG. 4 is a cross-sectional view showing a pedal device for a vehicle according to an exemplary embodiment of the present disclosure. FIG. 5 is a perspective view showing a pedal arm according to an exemplary embodiment of the present disclosure. FIG. 6 is a side view showing a pedal arm according to an exemplary embodiment of the present disclosure. In FIGS. 5 and 6, an example is illustrated with a pedal housing omitted for description purposes.

Referring to FIGS. 1 to 6, a pedal device for a vehicle 1 according to an exemplary embodiment of the present disclosure may include a pedal arm 100, a pedal reaction force generator 200, and a friction force generator 300. In an exemplary embodiment of the present disclosure, the pedal device for the vehicle 1 is shown as a pendant type that is coupled to a dash panel, and the pedal device will be described with an example as an acceleration pedal of the vehicle. However, the present disclosure is not limited thereto, and the pedal device for the vehicle 1 according to an exemplary embodiment of the present disclosure may be used for deceleration of the vehicle, and may be similarly applied to an organ type that is installed on a floor panel of the vehicle.

A pedal pad 110 may be formed at an end of the pedal arm 100 to receive an operating force (stepping force) from the driver (e.g., by stepping or depressing with a foot) to rotate the pedal arm 100. When the driver steps on (e.g., depresses) the pedal pad 110 or releases the pedal pad 110, the pedal arm 100 may be rotated about a rotational axis Ax. In an exemplary embodiment of the present disclosure, the pedal device for the vehicle 1 is described as a pendant type by way of example. Therefore, it may be understood that the pedal pad 110 may be formed at a first end of the pedal arm 100 proximate to the floor panel of the vehicle, and when the driver steps on or releases the pedal pad 110, a second end of the pedal arm 100 may be rotated about the rotational axis Ax. The pedal arm 100 may be configured to allow the second end proximate to the rotational axis Ax to be accommodated in a pedal housing 400.

Figure 7:
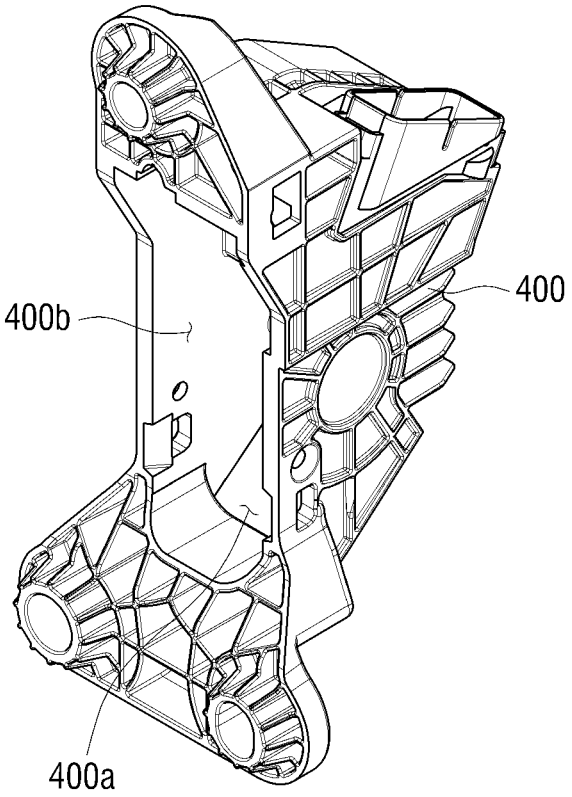
FIG. 7 is a perspective view showing a pedal housing according to an exemplary embodiment of the present disclosure.
Figure 8:
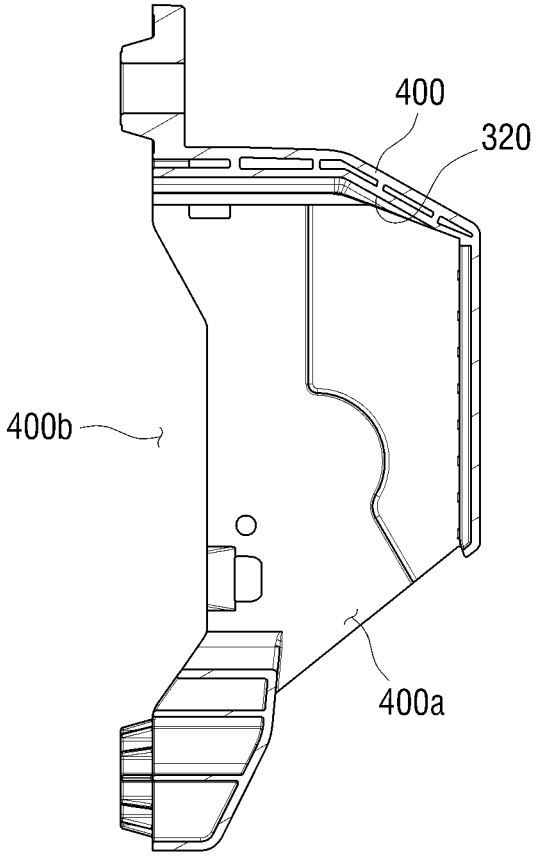
FIG. 8 is a cross-sectional view showing a pedal housing according to an exemplary embodiment of the present disclosure.

FIG. 7 is a perspective view showing a pedal housing according to an exemplary embodiment of the present disclosure, and FIG. 8 is a cross-sectional view showing a pedal housing according to an exemplary embodiment of the present disclosure. Referring to FIGS. 7 and 8, an insertion aperture 400*a* may be formed at a rear side of the pedal housing 400 to allow the second end of the pedal arm 100 to be inserted therethrough, and an opening 400*b* may be formed at a front side of the pedal housing 400 in which a support 410 may be disposed, as will be described below. The support 410 and the pedal housing 400 may maintain the rotational axis Ax of the pedal arm 100 at a predetermined position to allow the pedal arm 100 to rotate about the rotational axis Ax.

Further, a contact surface 320 may be formed on an inner surface of the pedal housing 400 adjacent to the second end of the pedal arm 100 that is proximate to the rotational axis Ax. The contact surface 320, along with a contact 310 that will be described below, may generate a friction force for generating hysteresis as the pedal arm 100 rotates, and a detailed description thereof will be described below.

In response to the driver depressing the pedal pad 100, the pedal reaction force generator 200 may generate the pedal reaction force in a direction opposite to a direction in which the driver steps on the pedal pad 100. In an exemplary embodiment of the present disclosure, the pedal reaction force generator 200 may include an elastic member. Therefore, as the driver steps on the pedal pad 100, the pedal reaction force generator 200 may be compressed, and the pedal reaction force that corresponds to a restoring force generated thereby may be applied in a direction opposite to the direction in which the driver steps on the pedal pad 100. In an exemplary embodiment of the present disclosure, the pedal reaction force generator 200 may include a coil spring. However, the present disclosure is not limited thereto, and various types of springs which are compressed and generate a restoring force when the driver steps on the pedal pad 100 may be used in the pedal reaction force generator 200.

A first end of the pedal reaction force generator 200 may be disposed in the support 410 coupled to the opening 400*b* formed at the front side of the pedal housing 400, and a second end of the pedal reaction force generator 200 may be disposed on a surface of the pedal arm 100 that faces the support 410. Therefore, when the driver steps on the pedal pad 110, as the surface of the pedal arm 100 that faces the support 410 approaches the support 410, the pedal reaction force generator 200 may be compressed to generate the pedal reaction force corresponding to the restoring force.

Figure 9:
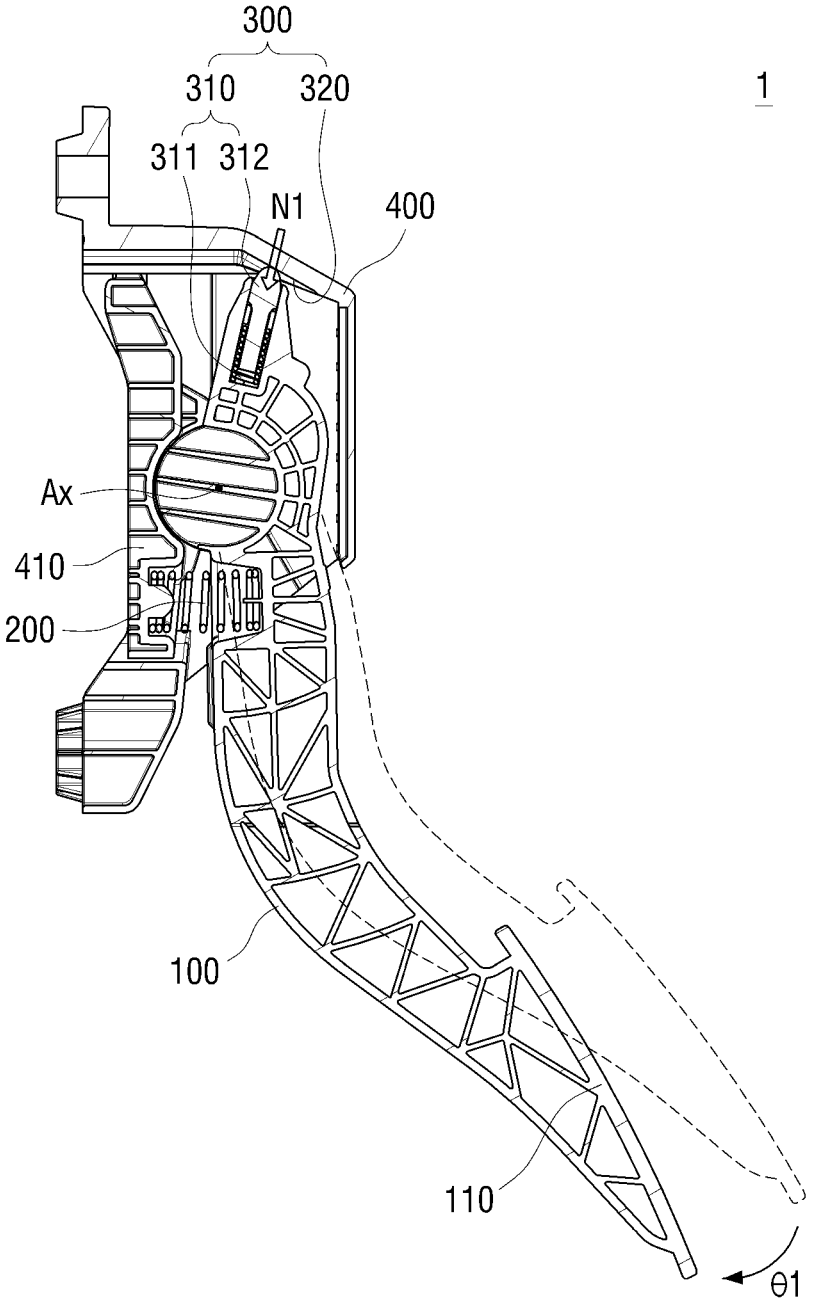
FIG. 9 is a cross-sectional view showing a pedal device for a vehicle in which a pedal arm rotates by a first angle according to an exemplary embodiment of the present disclosure.
Figure 10:
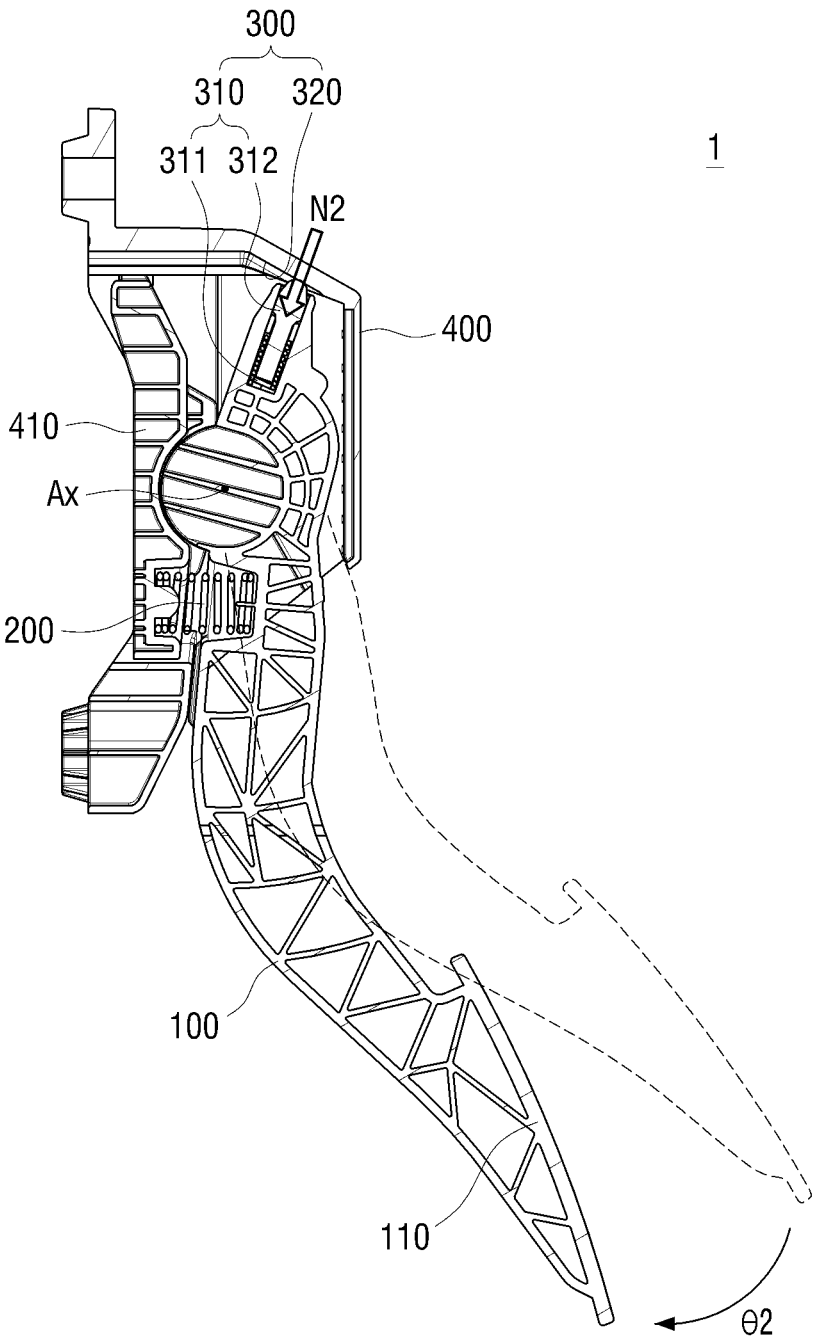
FIG. 10 is a cross-sectional view showing a pedal device for a vehicle in which a pedal arm rotates by a second angle according to an exemplary embodiment of the present disclosure.

In particular, as a rotation angle of the pedal arm 100 increases due to the driver stepping on the pedal pad 110, the degree of compression of the pedal reaction force generator 200 increases, thereby increasing the restoring force. Therefore, the pedal reaction force generator 200 may generate a greater pedal reaction force as the rotation angle of the pedal arm 100 increases. Namely, as shown in FIGS. 9 and 10, since the degrees of compression of the pedal reaction force generator 200 are different when the rotation angles of the pedal arm 100 are different, the magnitude of the pedal reaction force generated by the pedal reaction force generator 200 may also be varied. In other words, compared to a case where the pedal arm 100 is rotated by a first angle θ1, as shown in FIG. 9, with respect to a base position of the pedal arm 100 (i.e., a position of the pedal arm 100 when the pedal pad 110 is undepressed), a case where the pedal arm 100 is rotated by a second angle θ2 that is greater than the first angle θ1, as shown in FIG. 10, may cause an increased degree of compression of the pedal reaction force generator 200 and may generate a greater pedal reaction force.

Figure 11:
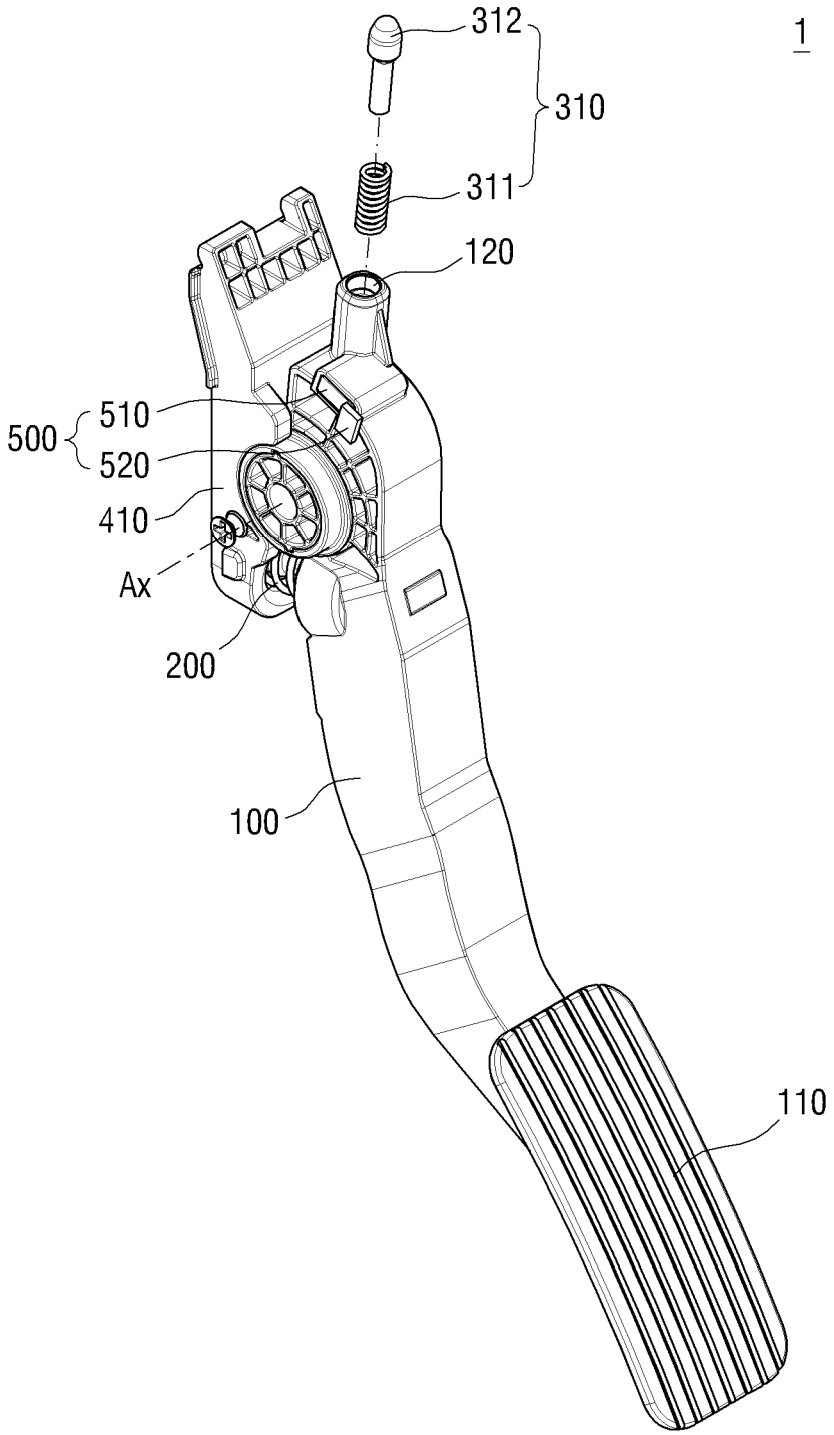
FIG. 11 is an exploded perspective view showing a contact according to an exemplary embodiment of the present disclosure.

The friction force generator 300 may include the contact 310 disposed at the second end of the pedal arm 100 that is proximate to the rotational axis Ax and the contact surface 320 formed along a movement path of the contact 310 based on the rotation of the pedal arm 100. The contact 310 may be received in a receiving groove 120 formed at the second end of the pedal arm 100 proximate to the rotational axis Ax. As shown in FIG. 11, the contact 310 may include an elastic member 311 inserted into the receiving groove 120 and a bullet 312, which is elastically supported by the elastic member 311. Since the bullet 312 is elastically supported by the elastic member 311, as the pedal arm 100 is rotated, an end of the bullet 312 may move while maintaining a contact with the contact surface 320.

The contact surface 320 may be formed along a movement path of the bullet 312. The contact surface 320 may be formed such that a distance from the rotational axis Ax of the pedal arm 100 gradually decreases as it goes from a first side, which corresponds to a position of the bullet 312 when the pedal pad 110 is undepressed, to a second side, which corresponds to a position that the bullet 312 approaches as the pedal pad 110 is depressed and the pedal arm 100 is rotated. In an exemplary embodiment of the present disclosure, the contact surface 320 may be formed on an inner surface of the pedal housing 400 at a position adjacent to the second end of the pedal arm 100 that is proximate to the rotational axis Ax. However, the present disclosure is not limited thereto, and the contact surface 320 may be formed separately from the pedal housing 400.

The friction force generator 300 may vary a magnitude of the friction force generated depending on a magnitude of a force applied to the contact surface 320 by the bullet 312. The friction force generator 300 may generate a friction force that is exerted in a first direction opposite to a direction in which the operating force of the pedal arm 100 is applied when the driver steps on the pedal pad 110, thereby increasing a force required by the driver. When the driver releases the foot from the pedal pad 110, the friction force generator 300 may generate hysteresis by generating a friction force that is exerted in a second direction opposite to the first direction, thereby decreasing the force required by the driver.

Due to the contact surface 320 formed in a configuration that the distance between the contact surface 320 and the rotational axis Ax of the pedal arm 100 decreases as it goes from the first side to the second side, a magnitude of the friction force generated between the contact 310 and the contact surface 320 may be increased so that, when the driver steps on the pedal pad 100, the required stepping force becomes greater as the rotation angle of the pedal arm 100 increases.

More specifically, the magnitude of the friction force generated from the friction force generator 300 may increase as a force applied to the contact surface 320 by the contact 310 increases. As the rotation angle of the pedal arm 100 increases, the bullet 312 may move to a point (e.g., the second side) where a distance between the contact surface 320 and the rotational axis Ax of the pedal arm 100 becomes smaller. Therefore, the elastic member 311 that elastically supports the bullet 312 may be compressed more, and thus, the restoring force may be increased, thereby increasing the force (e.g., a normal force) applied to the contact surface 320.

The increase in the magnitude of the friction force generated by the friction force generator 300 may be understood as that a resistance against the direction in which the pedal arm 100 rotates is increased as the driver steps on the pedal pad 110. As a result, when the driver steps on the pedal pad 110, the required force increases as the rotation angle of the pedal arm 100 increases.

The friction force generated by the friction force generator 300 may be obtained by Equation 1 below.

$$f=\mu N \qquad \text{[Equation 1]}$$

In Equation 1, f denotes a friction force, μ denotes a friction coefficient, and N denotes a normal force. As a magnitude of the force applied to the contact surface 320 by the contact 310 increases, a magnitude of the normal force generated from the contact surface 320 increases, thereby increasing a magnitude of the friction force. As a result, a resistive force exerting in a direction opposite to a direction in which the driver steps on the pedal pad 110 is increased.

For example, when it is changed from a state in which the pedal pad 100 is undepressed to a state in which the driver steps on the pedal pad 100 and the pedal arm 100 is rotated to the first angle θ1 as shown in FIG. 9 described above, a normal force of N1 may be generated from the contact surface 320. When the pedal arm 100 is rotated to the second angle θ2 greater than the first angle θ1 as shown in FIG. 10 described above, a force applied on the contact surface 320 by the contact 310 may become greater, so that a normal force of N2 greater than N1 may be generated due to the bullet 312 disposed closer to the second side of the contact surface 320.

Accordingly, when the driver steps on the pedal pad 110 and the rotation angle of the pedal arm 100 is increased, the magnitude of the force applied to the contact surface 320 by the contact 310 increases, the normal force generated from the contact surface 320 is increased, and thus, the magnitude of the friction force generated between the contact 310 and the contact surface 320 may also be increased.

Figure 12:
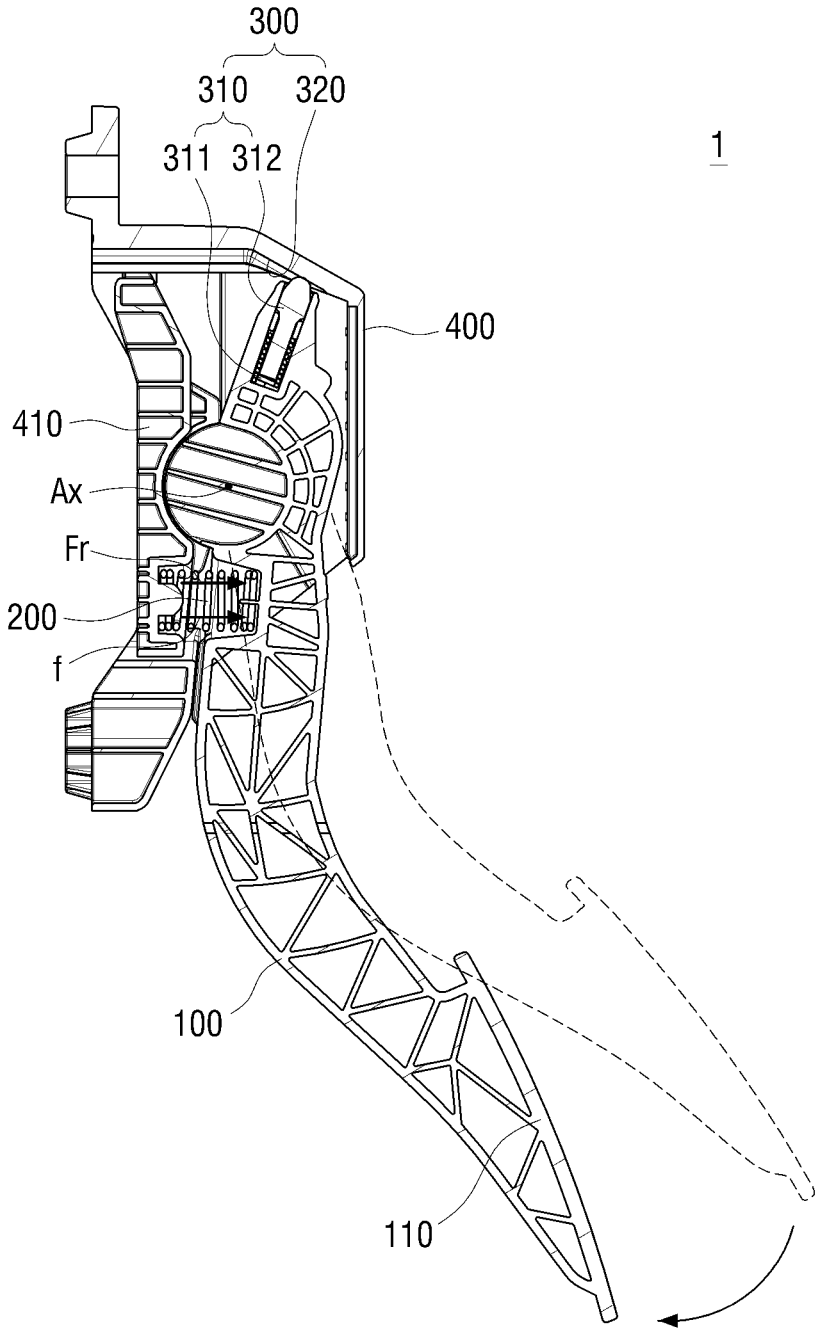
FIG. 12 is a schematic diagram showing the total pedal reaction force required when a driver steps on a pedal pad according to the exemplary embodiment of the present disclosure.
Figure 13:
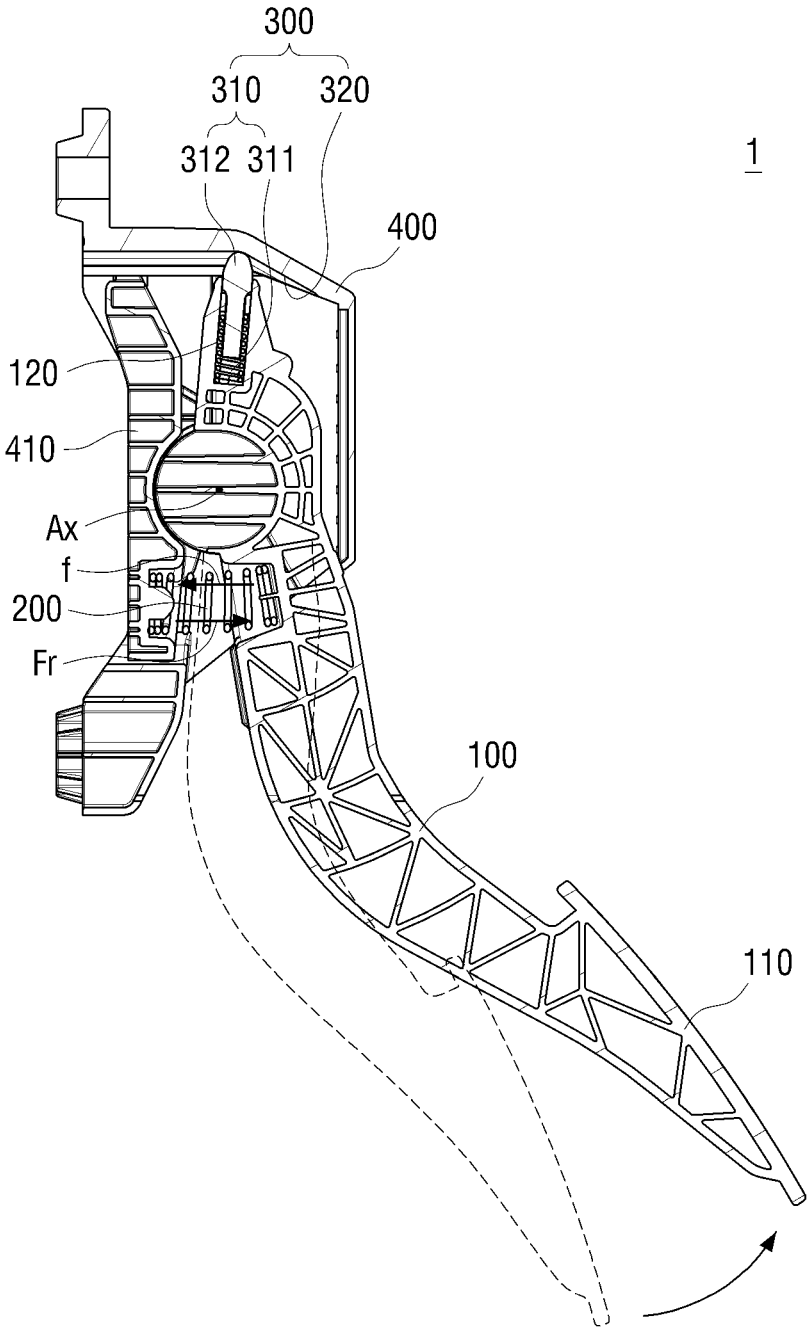
FIG. 13 is a schematic diagram showing the total pedal reaction force required when a driver releases a pedal pad according to an exemplary embodiment of the present disclosure.

In the pedal device for the vehicle 1 of the present disclosure as described above, when the driver steps on the pedal pad 110 and the rotation angle of the pedal arm 100 increases, the total stepping force required by the driver may be represented as the sum of the pedal reaction force Fr generated by the pedal reaction force generator 200 and the friction force f generated by the friction force generator 300 as shown in FIG. 12. Conversely, when the driver releases the foot from the pedal pad 110 and the rotation angle of the pedal pad 110 decreases, the total stepping force required by the driver may be represented as a force obtained by subtracting the friction force f generated by the friction force generator 300 from the pedal reaction force Fr generated by the pedal reaction force generator 200 as shown in FIG. 13, and the hysteresis may be generated as the driver operates the pedal.

Figure 14:
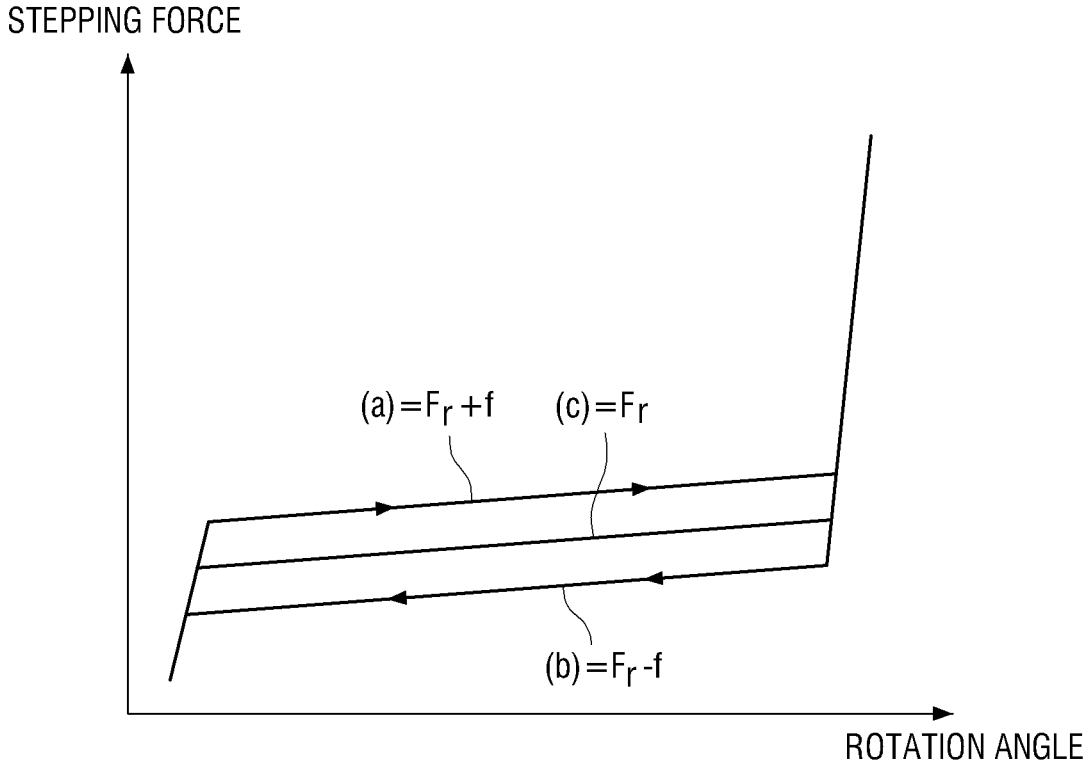
FIG. 14 is a graph showing the hysteresis effect generated by a pedal device for a vehicle according to an exemplary embodiment of the present disclosure.

In other words, in the pedal device for the vehicle 1 of the present disclosure, the total stepping force required by the driver when the driver steps on the pedal pad 110 may be a force obtained by adding the pedal reaction force Fr generated by the pedal reaction force generator 200 to a friction force f generated by the receiving unit 210 and the contact 310 as shown as (a) in FIG. 14, which increases as the rotation angle (stroke) of the pedal arm 100 increases. On the other hand, the total stepping force required by the driver when the driver releases the pedal pad 110 may become smaller than the total stepping force of depressing the pedal since a part of the pedal reaction force Fr generated by the pedal reaction force generator 200 is canceled by the friction force f generated by the friction force generator 300 as shown as (b) in FIG. 14. Therefore, the fatigue experienced by the driver for operating the pedal may be reduced. Here, (c) of FIG. 14 illustrates a stepping force required by the driver when no friction force is generated from the friction force generator 300. In this case, only the pedal reaction force by the pedal reaction force generator 200 is exerted, and thus, the same pedal reaction force is generated when the driver steps on the pedal pad 110 and when the driver releases the pedal pad 110.

Referring to FIGS. 1 to 6 again, the pedal device for the vehicle 1 according to an exemplary embodiment of the present disclosure may further include a position detecting unit 500 for detecting a position of the pedal arm 100 to adjust the amount of combustion (e.g., fuel-burn). The position detecting unit 500 may include a magnet 510 and a sensor unit 520. The position of the magnet 510 may be changed as the pedal arm 100 rotates. In an exemplary embodiment of the present disclosure, the magnet 510 disposed at the second end proximate to the rotational axis Ax of the pedal arm 100 while being spaced apart from the rotational axis Ax by a predetermined interval. Accordingly, the magnet 510 may be rotated about the rotational axis Ax with the pedal arm 100 to change its position. However, the present disclosure is not limited thereto, and the magnet 510 may be disposed so that its center coincides with the rotational axis Ax of the pedal arm 100, and the position of the magnet 510 may be rotated about the rotational axis Ax along with the pedal arm 100.

The sensor unit 520 may detect the strength of a magnetic force based on the position of the magnet 510, and may output a detection signal based on the detected strength of the magnetic force. The detection signal output from the sensor unit 520 may be used by an electronic control unit (ECU) of the vehicle to determine the rotation angle of the pedal arm 100 and to control the amount of fuel-burn based on the determined rotation angle. In other words, the displacement amount of the magnet 510 may vary based on the rotation angle of the pedal arm 100, the sensor unit 520 may detect the strength of the magnetic force based on the position of the magnet 510 corresponding to the rotation angle of the pedal arm 100 and transmit the detection signal to the ECU of the vehicle, and the ECU of the vehicle may determine the rotation angle of the pedal arm 100 based on the transmitted detection signal to control the amount of fuel-burn. Here, the rotation angle of the pedal arm 100 may be within an angular range between an angular position of pedal arm 100 without the driver stepping on the pedal pad 110 and an angular position of pedal arm 100 with the pedal arm 100 rotated to a full stroke.

The sensor unit 520 may include a plurality of sensors to minimize a detection error. In an exemplary embodiment of the present disclosure, the sensor unit 520 may include two sensors that output detection signals having different magnitudes depending on the position of the magnet 510. In this case, the ECU of the vehicle may control the amount of fuel-burn based on the detection signal of the preset sensor depending on the difference in magnitudes of the detection signal outputs from the two sensors. For example, when the difference in magnitudes of the detection signals of the two sensors is within a particular range, the ECU of the vehicle may control a throttle valve based on the greater detection signal among the signals of the two sensors. Alternatively, the ECU of the vehicle may control the amount of fuel-burn based on the smaller detection signal among the signals of the two sensors.

Accordingly, when the sensor unit 520 includes a plurality of sensors, the magnitude of the detection signal output from each of the plurality of sensors may be required to vary linearly with respect to the change in position of the magnet 510 to accurately obtain the difference in magnitudes of the detection signal outputs from the plurality of sensors. When the magnitude of the detection signal output from each of the plurality of sensors does not change linearly depending on the change in position of the magnet 510, it may be more difficult to accurately obtain the difference in magnitudes of the detection signal outputs from the plurality of sensors, and thus, the control may become more challenging.

For these sensors, the minimum displacement amount of the magnet 510 that ensures linearity may be specified by the manufacturer thereof. It may be necessary to allow the displacement amount of the magnet 510 to be equal to or greater than the minimum displacement amount to allow the detection signal output from the sensor unit 520 to be linearly changed. In an exemplary embodiment of the present disclosure, the magnet 510 may be spaced apart from the rotational axis Ax of the pedal arm 100 by the predetermined interval and may rotate about the rotational axis Ax. Therefore, it may be understood that the displacement amount of the magnet 510 may be a rotation angle range of the magnet 510.

Generally, when the rotation angle range of the pedal arm 100 is A (0 to A), the magnet 510 may be mounted at a position where the rotation angle range of the magnet 510 may be detected by the sensor unit 520 to be A (0 to A) as well, based on the strength of the magnetic force detected by the sensor unit 520. When the rotation angle range of the pedal arm 100 is smaller than the minimum displacement amount (minimum rotation angle range) that ensures the linearity of the sensor unit 520, the linearity of the detection signal output from the sensor unit 520 may not be ensured.

When the displacement amount of the magnet 510 is smaller than the minimum displacement amount to ensure the linearity, the displacement amount of the magnet 510 may be increased (e.g., amplified) using a separate gear to allow the displacement amount of the magnet 510 to be greater than the minimum displacement amount or by disposing the magnet 510 farther from the rotational axis Ax of the pedal arm 100. Alternatively, according to an exemplary embodiment of the present disclosure, a multipole magnetized magnet may be used as the magnet 510 to allow the displacement amount of the magnet 510 detected by the sensor unit 520 to be greater than the minimum displacement amount even when the actual displacement amount of the magnet 510 is smaller than the minimum displacement amount.

Increasing the displacement amount of the magnet 510 using the separate gear may be implemented by, when the center of the magnet 510 coincides with the rotational axis Ax of the pedal arm 100, adjusting a gear ratio using the separate gear to allow the magnet 510 to rotate in an angular range greater than the rotation angle range of the pedal arm 100. Positioning the magnet 510 farther from the rotational axis Ax of the pedal arm 100 may allow the range of the magnetic force detected by the sensor unit 520 based on the position of the magnet 510 to have a greater range than the range of the magnetic force based on the rotation angle range of the pedal arm 100. Therefore, in an exemplary embodiment of the present disclosure, the linearity of the detection signal output from the sensor unit 520 may be ensured without increasing the complexity of the configuration or increasing the overall size of the device.

In an exemplary embodiment of the present disclosure, two or more poles of the magnet 510 may be alternately arranged in a direction in which a position of the magnet 510 changes due to the rotation of the pedal arm 100 (hereinafter, referred to as a "displacement direction"), and two or more poles may be alternately arranged in a direction perpendicular to the displacement direction of the magnet 510. The description that two or more poles are alternately arranged may mean that the total number of poles including N and S poles is equal to or greater than two, and the N and S poles are alternately arranged. As an example, it may be understood that alternately arranging 3 poles means arranging an N pole, an S pole, and an N pole in order, or an S pole, an N pole, and an S pole in order. Further, it may be understood that alternately arranging 4 poles means arranging an N pole, an S pole, an N pole, and an S pole in order, or an S pole, an N pole, an S pole, and an N pole in order.

Figure 15:
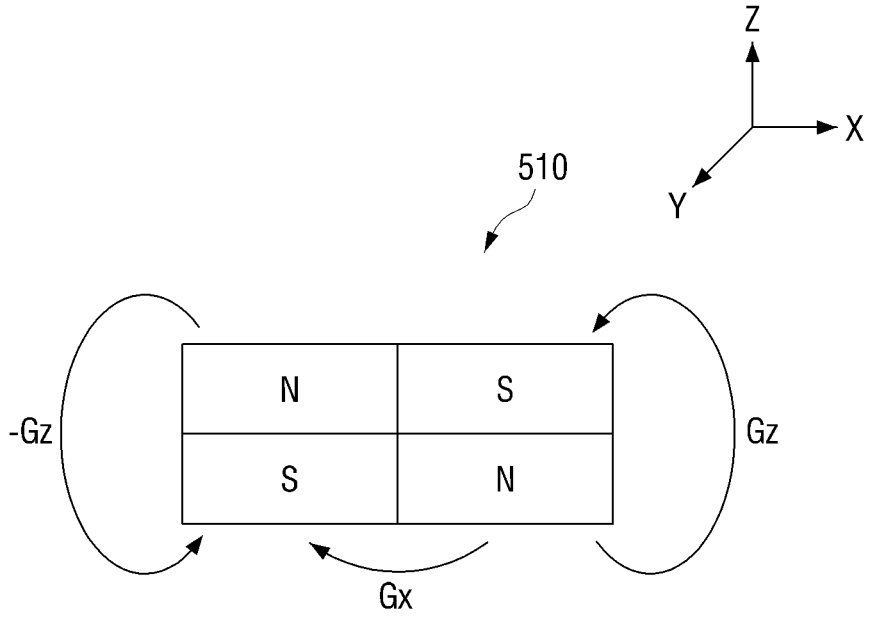
FIG. 15 is a schematic diagram showing the polar arrangement of magnets according to an exemplary embodiment of the present disclosure.

In other words, in the magnet 510, the N and S poles may be alternately arranged in both the displacement direction of the magnet 510 and the direction perpendicular to the displacement direction by alternately arranging the N poles and the S poles in the displacement direction and alternately arranging the N poles and the S poles in the direction perpendicular to the displacement direction, as shown in FIG. 15. Accordingly, when the N pole and the S pole are alternately arranged in the displacement direction of the magnet 510 and the direction perpendicular thereto, magnetic force lines Gz and −Gz that extend in the z-axis direction corresponding to the direction perpendicular to the displacement direction as well as magnetic force lines Gx that extend in the x-axis direction corresponding to the displacement direction of the magnet 510 may be formed.

In FIG. 15, the magnetic force lines Gz and −Gz that extend in the direction perpendicular to the displacement direction may have a positive value and a negative value to indicate a direction in which the magnetic force lines extend. Here, Gz may refer to a magnetic force line that extends from a pole proximate to the sensor unit 520 to a pole distant from the sensor unit 520, and −Gz may refer to a magnetic force line that extends from the pole distant from the sensor unit 520 to the pole proximate to the sensor unit 520.

In order to allow the sensor unit 520 to detect the displacement amount of the magnet 510 based on the strength of the magnetic force in the z-axis direction corresponding to the direction perpendicular to the displacement direction of the magnet 510, the two or more poles may be alternately arranged in the displacement direction of the magnet 510 and in the direction perpendicular thereto, which will be described in detail below.

When the two or more poles are alternately arranged in the direction perpendicular to the displacement direction of the magnet 510, the strength of the magnetic force corresponding to the magnetic force line that extends between the poles disposed at both ends in the direction perpendicular to the displacement direction may be detected. Therefore, two poles may be arranged in the direction perpendicular to the displacement direction to prevent the size of the magnet 510 from increasing and thereby to prevent the overall size from being increased.

Further, in an exemplary embodiment of the present disclosure, when the two or more poles of the magnets 510 are alternately arranged in the displacement direction, the strength of the magnetic force corresponding to the magnetic force line that extends between the poles disposed at both ends in the direction of displacement may be detected. Therefore, two poles may be arranged in the displacement direction to prevent the size of the magnet 510 from increasing and thereby to prevent the overall size from increasing.

Accordingly, in an exemplary embodiment of the present disclosure, the multipolar magnet may be used as the magnet 510. Therefore, the linearity of the detection signal output from the sensor unit 520 may be ensured without using a separate gear or changing the position of the magnet 510 even when the magnet 510 has a displacement amount smaller than the minimum displacement amount that causes the detection signal output from the sensor unit 520 to change linearly. In other words, when the two or more poles of the magnets 510 are alternately arranged in the displacement direction and in the direction perpendicular thereto, the linearity with respect to the detection signal output from the sensor unit 520 may be ensured even with a smaller displacement, compared to a case where the magnet 510 has only a single N pole and a single S pole arranged in the displacement direction.

Again, the displacement amount of the magnet 510 may be determined based on the strength of the magnetic force detected by the sensor unit 520. The magnetic force may be detected in a range greater than a range of the strength of the magnetic force corresponding to the rotation angle range of the pedal arm 100. Due to the configuration according to an exemplary embodiment of the present disclosure, the actual displacement amount of the magnet 510 may be smaller than the minimum displacement amount, and the displacement amount detected by the sensor unit 520 may be greater than the minimum displacement amount.

Figure 16:
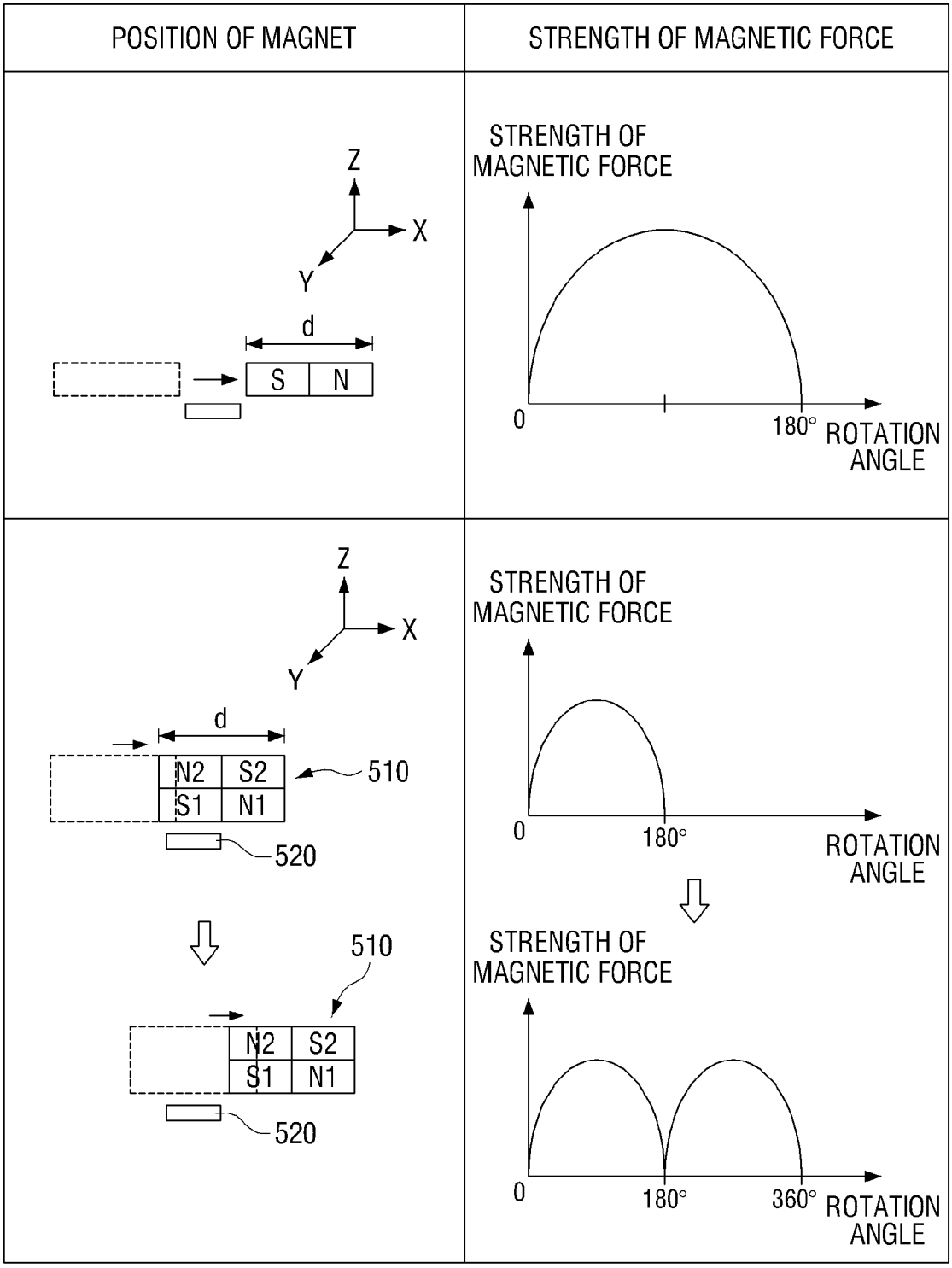
FIG. 16 is a schematic diagram showing the strength of a magnetic field according to the change in position of a magnet according to an exemplary embodiment of the present disclosure.

FIG. 16 is a schematic diagram showing a rotation angle detected by a sensor unit based on the position change of a magnet 510 according to an exemplary embodiment of the present disclosure. FIG. 16 compares a case in which the magnet 510 has a single N pole and a single S pole in the displacement direction ("dipole magnet") and a case in which the two polarities are alternately arranged in the displacement direction and the direction perpendicular thereto ("multipole magnet"). In FIG. 16, N1 and N2 may denote N poles disposed at different positions. Similarly, S1 and S2 may denote S poles disposed at different positions. The multipole magnet may include, but not limited to, a quadrupole magnet, a sextupole magnet, an octupole magnet, and the like.

Referring to FIG. 16, for the dipole magnet, in response to the position change of the magnet 510 as the magnet 510 enters a detection range of the sensor unit 520 and leaves out of the detection range, the strength of the magnetic force detected by the sensor unit 520 may gradually increase from the time when the magnet 510 enters the detection range of the sensor unit 520 from one side of the sensor unit 520, may become a maximum when the center of the magnet 510 aligns with the center of the sensor unit 520, and may gradually decrease until the magnet 510 leaves out of the detection range of the sensor unit 520 to the other side of the sensor unit 520.

Presumably, in case the displacement amount that ensures the linearity of the detection signal of the sensor unit 520 is when the magnet 510 is rotated by 120 degrees or more, and the displacement amount of the magnet 510 (i.e., the position change of the magnet 510 from the position it enters the detection range of the sensor unit 520 from one side to the position it leaves out of the detection range of the sensor unit 520 to the other side) is determined to be 180 degrees, the linearity of the detection signal output from the sensor unit 520 may not be ensured if the magnet 510 corresponds to a rotation angle of less than 120 degrees due to design or layout issues.

On the other hand, in an exemplary embodiment of the present disclosure, the sensor unit 520 may detect that the magnet 510 has a displacement amount corresponding to the rotation range of greater than 120 degrees even when the magnet 510 actually has a displacement amount corresponding to the rotation angle smaller than 120 degrees, thereby ensuring the linearity of the detection signal output from the sensor unit 520.

In other words, when the N poles and the S poles of the magnet 510 are alternately arranged in the displacement direction of the magnet 510 and in the direction perpendicular thereto, the sensor unit 520 may detect the strength of the magnetic force corresponding to the magnetic force line that extends from the N1 pole to the S1 pole. Further, the sensor unit 520 may detect the strength of the magnetic force in the direction perpendicular to the displacement direction, i.e., the strength of a magnetic force corresponding to magnetic field lines that extend from the N1 pole to the S2 pole and the strength of a magnetic force corresponding to magnetic field lines that extend from the N2 pole to the S1 pole.

Assuming that a length of the multipole magnet 510 in the displacement direction is the same as a length of the dipole magnet, the strength of a magnetic force from the point when the magnet 510 begins to enter the detection range of the sensor unit 520 to a half length of the magnet 510 may behave similarly as in a case where the dipole magnet is moved by a full length, i.e., the strength of a magnetic force until the N1 and S2 poles are out of the detection range of the sensor unit 520 shows a profile similar to a profile of a full length displacement of the dipole magnet.

Therefore, the sensor unit 520 may detect the displacement amount of the magnet 510 by the half length of the magnet 510 (i.e., when the N1 and S2 poles are out of the detection range of the sensor unit 520) to be 180 degrees. Accordingly, even though the actual displacement amount of the magnet 510 is 60 degrees, the sensor unit 520 may detect the displacement amount to be 120 degrees, thereby ensuring the linearity.

Thereafter, as the magnet 510 continues to move, the sensor unit 520 may begin to detect a magnetic force corresponding to a magnetic force line from the N2 pole to the S1 pole. When the entire magnet 510 is out of the detection range of the sensor unit 520, the sensor unit 520 may detect the displacement amount of the magnet 510 as 180 degrees.

Accordingly, the sensor unit 520 may detect that the magnet 510 has a displacement amount of 0 to 180 degrees at a position where a half of the magnet 510 is outside the detection range of the sensor unit 520, and may detect that the magnet 510 has a displacement amount of 180 to 360 degrees at a position where the entire magnet 510 is out of the detection range of the sensor unit 520. In other words, for the magnet 510 of an exemplary embodiment of the present disclosure, a detection signal based on the displacement amount may be output similar to a dipole magnet, even when the displacement amount is half compared to the dipole magnet. Therefore, the linearity with respect to the detection signal output from the sensor unit 520 may be ensured even with a smaller rotation angle of the pedal arm 100.

FIG. 16 illustrates an example where the sensor unit 520 detects that the magnet 510 has a double displacement amount, when the magnet 510 has the same length d along the displacement direction as the dipole magnet and the actual displacement amount is the same. However, the present disclosure is not limited thereto. When a length of the magnet, in which the two or more poles arranged in the direction perpendicular to the displacement direction are disposed along the displacement direction, is smaller than a length of the dipole magnet, the displacement amount detected by the sensor unit 520 may become greater than the actual displacement amount of the magnet 510, thereby ensuring the linearity. Further, the displacement amount detected by the sensor unit 520 relative to the actual displacement amount of the magnet 510 may be adjusted by adjusting the length in which the two or more poles arranged in the direction perpendicular to the displacement direction are formed in the displacement direction.

Figure 17:
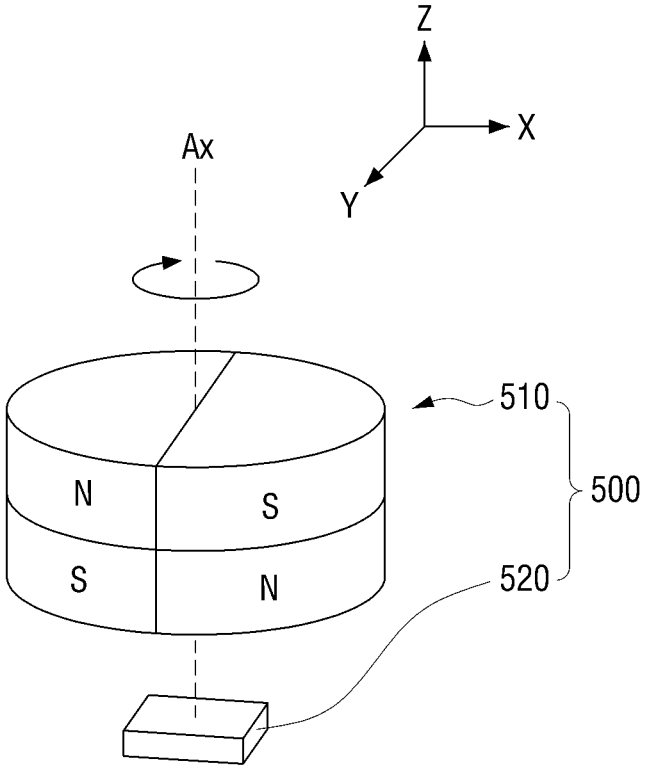
FIG. 17 is a schematic diagram showing the polar arrangement of magnets according to another exemplary embodiment of the present disclosure.

In the exemplary embodiment as described above, the magnet 510 is described to be spaced apart from the rotational axis Ax by the predetermined intervals and rotated about the rotational axis Ax as the pedal arm 100 rotates. However, the description may be similarly applied when the center of the magnet 510 is disposed to coincide with the rotational axis Ax and is rotated about the rotational axis Ax during the rotation of the pedal arm 100. For example, when the magnet 510 is disposed to coincide with the rotational axis Ax, it may be understood that the displacement direction of the magnet 510 is rotated about the rotational axis Ax. In this case, similar to the exemplary embodiment described above, the two or more poles may be alternately arranged in the displacement direction, and the two or more poles may be alternately arranged in the direction perpendicular to the displacement direction, as shown in FIG. 17. In this case, the sensor unit 520 may detect the strength of the magnetic force in the x-axis and the y-axis direction, and at the same time, may detect the strength of the magnetic force in the z-axis direction. Therefore, as in the exemplary embodiment describe above, the displacement amount detected by the sensor unit 520 may become greater than the actual displacement amount of the magnet 510.

In the exemplary embodiment described above, the description has been presented for the pendant type, in which two or more poles are alternately arranged in a direction in which the magnet 510 changes in position as the pedal arm 100 rotates and in a direction perpendicular to the displacement direction of the magnet 510, so that even with a relatively small displacement amount, the linearity of the sensing signal output from the sensor unit 520 may be guaranteed. However, the present disclosure is not limited thereto, and it may be similarly applied to the organ type.

Figure 18:
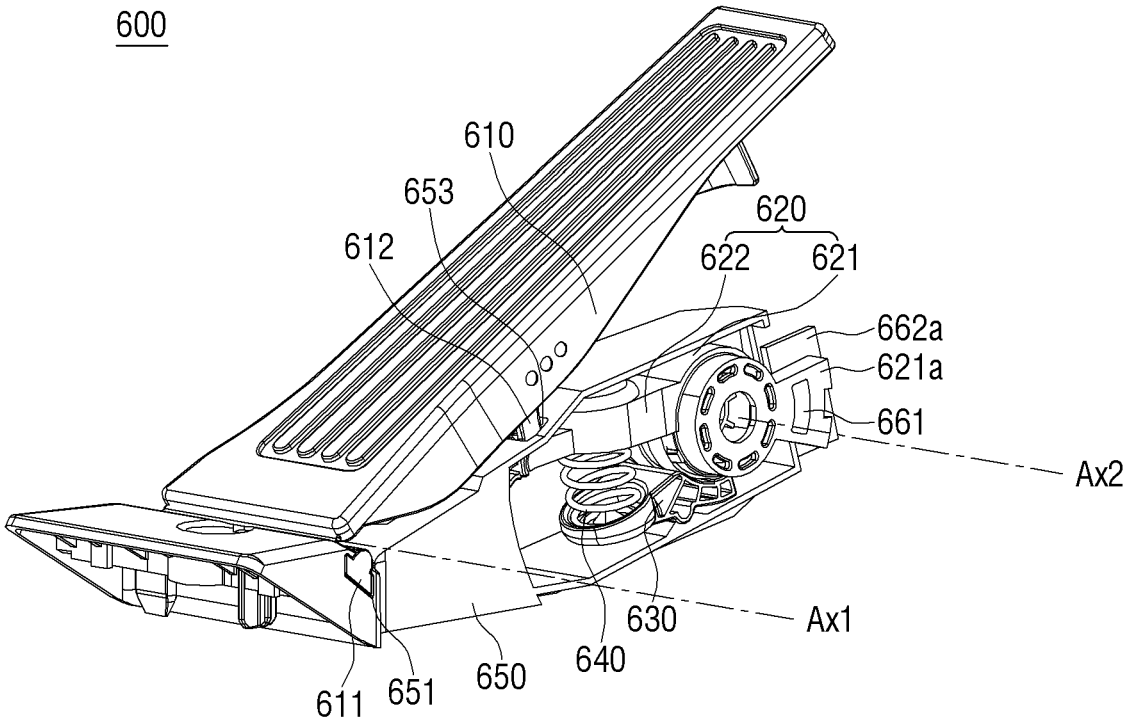
FIG. 18 is a perspective view showing a pedal device for a vehicle according to another exemplary embodiment of the present disclosure.
Figure 19:
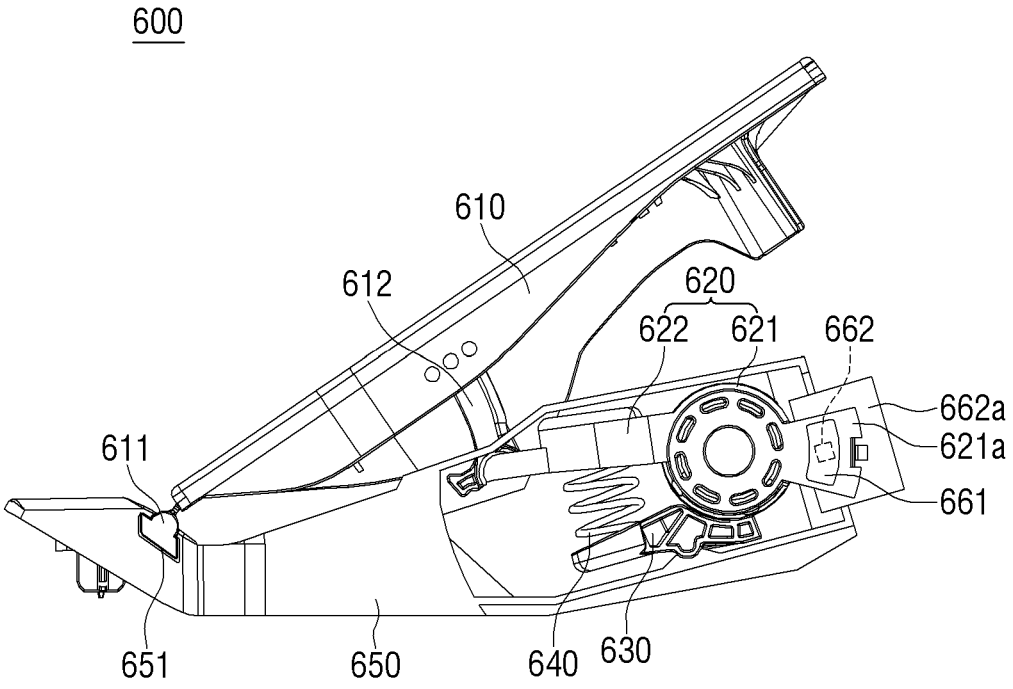
FIG. 19 is a side view showing a pedal device for a vehicle according to another exemplary embodiment of the present disclosure.
Figure 20:
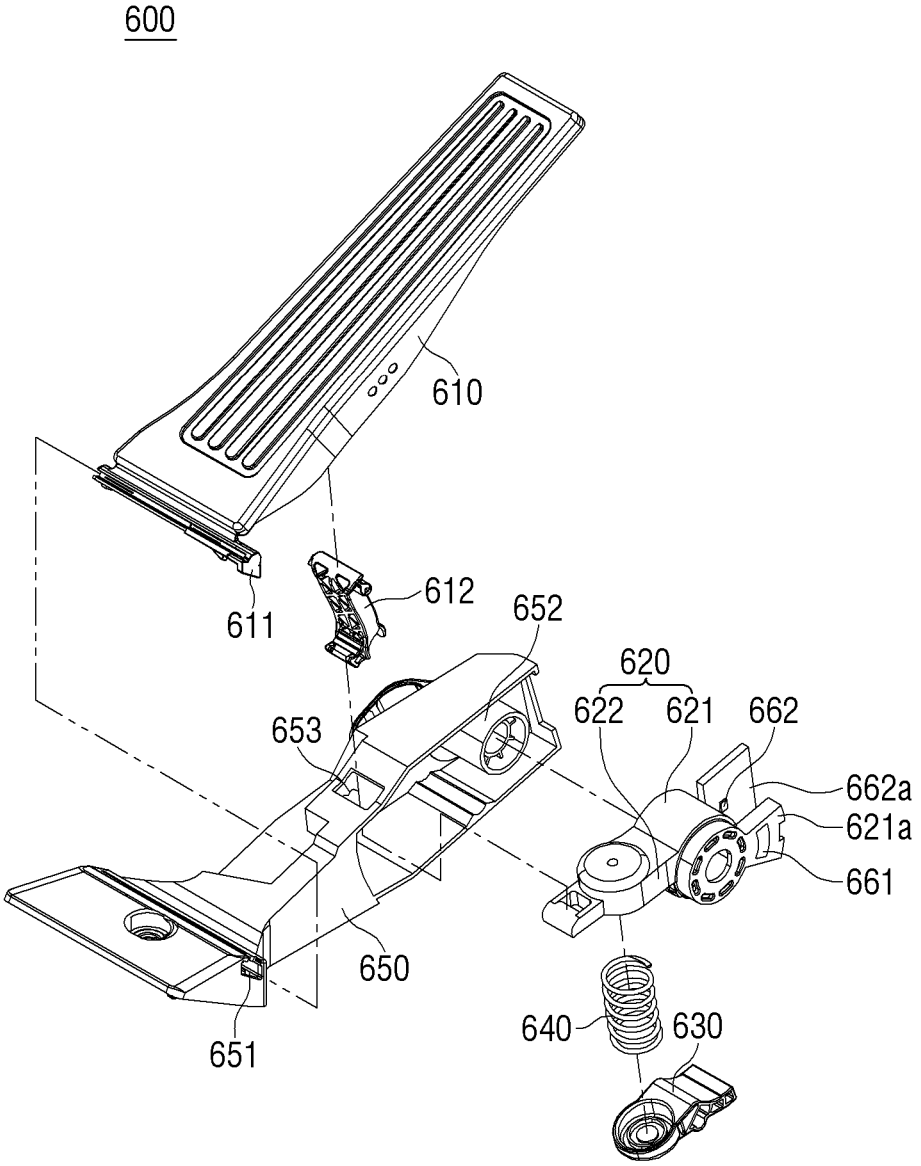
FIG. 20 is an exploded perspective view showing a pedal device for a vehicle according to another exemplary embodiment of the present disclosure.

FIG. 18 is a perspective view showing a pedal device for a vehicle according to another exemplary embodiment of the present disclosure, FIG. 19 is a side view showing a pedal device for a vehicle according to another exemplary embodiment of the present disclosure, and FIG. 20 is an exploded perspective view showing a pedal device for a vehicle according to another exemplary embodiment of the present disclosure. A pedal device for a vehicle 600 of FIGS. 18 to 20 is an example of the organ type.

Referring to FIGS. 18 to 20, the pedal device for the vehicle 600 according to another exemplary embodiment of the present disclosure may include a pedal pad 610, a carrier 620, a lever 630, and a pedal reaction force generator 640. The pedal pad 610 may include a hinge 611 inserted into a hinge coupling portion 651 formed in a housing 650 in a direction of a first axis Ax1 at an end of the pedal pad to allow the pedal pad 610 to be coupled to rotate about the first axis Ax1 outside the housing 650. The carrier 620 may be disposed within the housing 650 to rotate about a second axis Ax2 in conjunction with the pedal pad 610 when the driver steps on the pedal pad 610 or releases the foot from the pedal pad 610.

The carrier 620 may include a rotating unit 621 that rotates about the second axis Ax2, and an extension 622 formed to extend from the rotating unit 621 to transmit the operating force of the pedal pad 610 to the rotating unit 621. The rotating unit 621 may include an opening formed on a surface thereof to allow a shaft 652 formed in the housing 650 to be inserted, thereby rotating about the second axis Ax2. The extension 622 may be connected to the pedal pad 610 through a connecting rod 612 that penetrates an aperture 653 of the housing 650. Both ends of the connecting rod 612 may be respectively disposed inside and outside of the housing 650, thereby enabling the operating force of the pedal pad 610 to be transmitted to the rotating unit 621.

The lever 630 may allow a force corresponding to the operating force of the pedal pad 610 received from the carrier 620 via a first end to be applied to an outer surface of the rotating unit 621 via a second end that is in contact with the outer surface of the rotating unit 621. Accordingly, the resistive force acting in a direction opposite to a direction in which the driver steps on the pedal pad 610 may be generated. Therefore, the pedal reaction force may be changed when the driver steps on the pedal pad 610 and when the driver releases the pedal pad 610, and hysteresis may be caused. In other words, when the driver steps on the pedal pad 610 and a force is applied to the outer surface of the rotating unit 621 by the lever 630, the frictional force generated between an inner surface of the rotating unit 621 and an outer surface of the shaft 652 may increase, and thus the resistive force acting in the direction opposite to the direction in which the driver steps on the pedal pad 610 may be increased.

The pedal reaction force generator 640 may be made of an elastic member such as a coil spring. Both ends of the pedal reaction force generator 640 may be disposed at the carrier 620 and the lever 630, respectively, and generate the pedal reaction force in the direction opposite to the direction in which the driver steps on the pedal pad 610.

In particular, when the driver steps on the pedal pad 610, the total force may correspond to a force obtained by adding the pedal reaction force by the pedal reaction force generator 640 and the friction force generated between the rotating unit 621 and the shaft 652. On the other hand, when the driver releases the pedal pad 610, the total force may correspond to a force obtained by subtracting the friction force generated between the rotating unit 621 and the shaft 652 from the pedal reaction force by the pedal reaction force generator 640. As a result, hysteresis may occur.

A rotation angle of the rotating unit 621 may be detected to determine a stepping force amount or a rotation angle of the pedal pad 610. The rotation angle of the rotating unit 621 may be detected by a sensor unit 662 that detects a change in the magnetic force depending on the position of a magnet 661 that is integrally rotated with the rotating unit 621. The magnet 661 may be mounted to a mounting unit 621*a* that protrudes outward from the rotating unit 621. The sensor unit 662 may include at least one Hall sensor or the like installed on a substrate 622*a*. As a result, a detection signal corresponding to the change in the magnetic force depending on the position of the magnet 661 may be generated and output.

The magnet 661 of another exemplary embodiment of the present disclosure, similar to the exemplary embodiment described above, may include at least two or more poles that are alternately arranged in a direction in which the position of the magnet 661 changes as the rotating unit 621 rotates, and in a direction perpendicular to the direction in which the position of the magnet 661 changes, respectively. As a result, the linearity of the detection signal output from the sensor unit 662 may be ensured even with a relatively small amount of displacement as compared with a case where the magnet 661 has a single N pole and a single S pole in the displacement direction.

In other words, by using a multipolar magnetizing magnet as the magnet 661, even when the actual displacement amount of the magnet 661 is smaller than the minimum displacement amount, the displacement amount detected by the sensor unit 662 may become greater than the minimum displacement amount. Therefore, the linearity of the detection signal output from the sensor unit 662 may be ensured without changing a position of the magnet 661 or using a separate gear.

FIGS. 18 to 20 illustrates that since the extension 622 is formed to extend in the direction toward the first axis Ax1 from the rotating unit 621, the magnet 661 is disposed in the opposite direction with respect to the rotating unit 621, and the substrate 662*a* on which the sensor unit 662 is installed is disposed on a lateral side of the magnet 661 in the direction of the second axis Ax2 to prevent structural interference between the rotating unit 621 and the magnet 661. However, the present disclosure is not limited thereto, and the positions of the magnet 661 and the sensor unit 662 may vary as long as the structural interference is avoided.

In concluding the detailed description, those skilled in the art will appreciate that many variations and modifications can be made to the exemplary embodiments without substantially departing from the principles of the present disclosure. Therefore, the disclosed exemplary embodiments of the present disclosure are used in a generic and descriptive sense only and not for purposes of limitation.

What is claimed is:

1. A pedal device for a vehicle comprising:

a pedal arm rotatable about a rotational axis in a pedal housing;

a pedal reaction force generator for generating a pedal reaction force in a direction opposite to a direction in which an operating force of the pedal arm is applied via a pedal pad formed on the pedal arm;

a friction force generator, the friction force generator comprising a contact disposed at an end of the pedal arm proximate to the rotational axis and a contact surface formed on an inner surface of the pedal housing to be in contact with the contact of the pedal arm, wherein the friction force generator generates a friction force between the contact and the contact surface as the pedal arm rotates; and a position detection unit for detecting a position of the pedal arm, wherein the position detection unit comprises:

a magnet, wherein a position of the magnet is changed as the pedal arm rotates; and a sensor unit for detecting a strength of a magnetic force based on displacement of the magnet, wherein two or more poles are arranged in the magnet in a displacement direction and in a direction perpendicular to the displacement direction, wherein the pedal housing comprises:

an insertion aperture formed at a rear side thereof to allow the end of the pedal arm to be inserted therethrough; and an opening formed on a front side thereof to be coupled to a support, and wherein ends of the pedal reaction force generator are supported by the support of the pedal housing and the pedal arm.

2. The pedal device of claim 1, wherein the contact surface is formed to allow a distance between the rotational axis and the contact surface to decrease going from a first side to a second side along a movement path of the contact.

3. The pedal device of claim 1, wherein the contact comprises:

an elastic member inserted into a receiving groove formed at the end of the pedal arm; and a bullet that is elastically supported by the elastic member to allow an end thereof to be in contact with the contact surface, wherein the bullet is pressed in a direction of compressing the elastic member by the contact surface as the pedal arm rotates by the operating force.

4. The pedal device of claim 1, wherein the ends of the pedal reaction force generator are respectively supported by a surface of the support and a surface of the pedal arm that face each other, and wherein a rotation of the pedal arm due to the operating force causes the pedal reaction force generator to be compressed as the surface of the pedal arm facing the support approaches the support and to generate a restoring force.

5. The pedal device of claim 1, wherein the friction force generator generates a friction force depending on a force applied by the contact to the contact surface, and wherein, in response to depressing the pedal pad, the friction force is generated in a direction opposite to a direction in which the operating force is exerted, and, in response to releasing the pedal pad, the friction force is generated in a direction opposite to a direction in which the pedal reaction force is exerted.

6. The pedal device of claim 1, wherein the magnet is spaced apart from the rotational axis of the pedal arm by a predetermined interval and rotates about the rotational axis of the pedal arm as the pedal arm rotates.

7. The pedal device of claim 1, wherein the magnet is disposed with a center thereof coinciding with the rotational axis of the pedal arm and rotates about the rotational axis of the pedal arm as the pedal arm rotates.

8. The pedal device of claim 1, wherein the two or more poles of the magnet include an N pole and an S pole which are alternately arranged in the displacement direction and in the direction perpendicular thereto.

9. The pedal device of claim 1, wherein a detected displacement of the magnet that is detected by the sensor is greater than an actual displacement of the magnet.

10. The pedal device of claim 1, wherein the sensor unit detects the strength of the magnetic force corresponding to a magnetic force line that extends between the two or more poles arranged in the direction perpendicular to the displacement direction.

11. A pedal device for a vehicle comprising:

a pedal carrier rotatable about a rotational axis in a pedal housing;

a friction force generator for generating a friction force that provides a resistance as the pedal carrier rotates, and a position detection unit for detecting a position of the pedal carrier, wherein the position detection unit comprises:

a magnet, wherein a position of the magnet is changed as the pedal carrier rotates; and a sensor unit for detecting a strength of a magnetic force based on displacement of the magnet, wherein two or more poles are arranged in the magnet in a displacement direction and in a direction perpendicular to the displacement direction, wherein the friction force generator comprises:

a rotating unit rotatably coupled to a shaft of the pedal housing;

an extension that protrudes from the rotating unit;

a lever including a first end and a second end; and an elastic member inserted between the first end of the lever and the extension, wherein the second end of the lever is configured to apply a force to an outer surface of the rotating unit to generate the friction force, and wherein the elastic member of the friction force generator also generates a pedal reaction force in a direction opposite to a direction of an operating force applied to the pedal carrier.

12. The pedal device of claim 11, wherein the friction force increases as a rotation angle of the pedal carrier is increased.

13. The pedal device of claim 11, further comprising a pedal pad configured to transmit the operating force to the pedal carrier.

14. The pedal device of claim 11, wherein, in response to depressing the pedal carrier, the force is applied to the outer surface of the rotating unit by the lever, and the friction force between an inner surface of the rotating unit and an outer surface of the shaft of the pedal housing is increased.

15. A pedal device for a vehicle comprising:

a pedal arm rotatable about a rotational axis in a pedal housing;

a pedal reaction force generator for generating a pedal reaction force in a direction opposite to a direction in which an operating force of the pedal arm is applied via a pedal pad formed on the pedal arm;

a friction force generator, the friction force generator comprising a contact disposed at an end of the pedal arm proximate to the rotational axis and a contact surface formed on an inner surface of the pedal housing to be in contact with the contact of the pedal arm, wherein the friction force generator generates a friction force between the contact and the contact surface as the pedal arm rotates; and a position detection unit for detecting a position of the pedal arm, wherein the position detection unit comprises:

a magnet, wherein a position of the magnet is changed as the pedal arm rotates; and a sensor unit for detecting a strength of a magnetic force based on displacement of the magnet, wherein the entire sensor unit is disposed at one side of the entire magnet in a direction parallel to the rotational axis of the pedal arm, wherein two or more poles are arranged in a displacement direction of the magnet, and two or more poles are arranged in a transverse direction of the magnet, the transverse direction being perpendicular to the displacement direction, and wherein a length of one pole of the magnet measured along the displacement direction is predetermined to cause a perceived displacement of the magnet detected by the sensor unit to be greater than an actual displacement of the magnet and greater than a linear detection threshold of the sensor unit.

* * * * *